US011724525B2

(12) United States Patent
Miyase et al.

(10) Patent No.: US 11,724,525 B2
(45) Date of Patent: Aug. 15, 2023

(54) IMAGE RECORDING APPARATUS INCLUDING FIRST PRINT ENGINE PROVIDED AT FIRST CONVEYANCE PATH AND SECOND PRINT ENGINE PROVIDED AT SECOND CONVEYANCE PATH

(71) Applicant: BROTHER KOGYO KABUSHIKI KAISHA, Nagoya (JP)

(72) Inventors: Satoshi Miyase, Nagoya (JP); Yoshinori Osakabe, Seto (JP); Tsuyoshi Kuwayama, Kasugai (JP); Jun Morikawa, Nagoya (JP); Haruka Azechi, Nagoya (JP); Yasuo Ono, Nagoya (JP); Yuto Chiba, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/215,743

(22) Filed: Mar. 29, 2021

(65) Prior Publication Data

US 2021/0300087 A1 Sep. 30, 2021

(30) Foreign Application Priority Data

Mar. 31, 2020 (JP) ..... 2020-064246

(51) Int. Cl.
*B41J 13/00* (2006.01)
*B41J 11/58* (2006.01)
(Continued)

(52) U.S. Cl.
CPC ..... *B41J 13/0009* (2013.01); *B41J 3/46* (2013.01); *B41J 3/543* (2013.01); *B41J 11/58* (2013.01); *B41J 13/025* (2013.01); *B41J 13/106* (2013.01)

(58) Field of Classification Search
CPC . B41J 13/0009; B41J 3/46; B41J 3/543; B41J 11/58; B41J 13/025; B41J 13/106
See application file for complete search history.

(56) References Cited

U.S. PATENT DOCUMENTS 5,729,785 A * 3/1998 Sakaizawa ..... G03G 15/221 399/2
2014/0292973 A1 10/2014 Terada
2015/0070457 A1* 3/2015 Okuda ..... B41J 11/007 347/108

FOREIGN PATENT DOCUMENTS

JP H08-337011 A 12/1996
JP 2014-198437 A 10/2014

* cited by examiner

*Primary Examiner* — Henok D Legesse
(74) *Attorney, Agent, or Firm* — Scully, Scott, Murphy & Presser, PC

(57) ABSTRACT

A first conveyance path and a second conveyance path are formed in a housing. The first conveyance path extends in a conveyance direction to reach a first discharge port for discharging a sheet. The second conveyance path extends in the conveyance direction at a position higher than the first conveyance path to reach a second discharge port for discharging a sheet. The second discharge port is located at a position upstream of the first discharge port in the conveyance direction. A first print engine is provided at the first conveyance path. The first print engine is configured to print an image by using a recording agent on a sheet conveyed along the first conveyance path. A second print engine is provided at the second conveyance path. The second print engine is configured to print an image by using a recording agent on a sheet conveyed along the second conveyance path.

15 Claims, 13 Drawing Sheets

(51) Int. Cl.

| | |
|---|---|
| ***B41J 3/46*** | (2006.01) |
| ***B41J 13/02*** | (2006.01) |
| ***B41J 13/10*** | (2006.01) |
| ***B41J 3/54*** | (2006.01) |

IMAGE RECORDING APPARATUS INCLUDING FIRST PRINT ENGINE PROVIDED AT FIRST CONVEYANCE PATH AND SECOND PRINT ENGINE PROVIDED AT SECOND CONVEYANCE PATH

CROSS REFERENCE TO RELATED APPLICATIONS

This application claims priority from Japanese Patent Application No. 2020-064246 filed Mar. 31, 2020. The entire content of the priority application is incorporated herein by reference.

TECHNICAL FIELD

This disclosure relates to an image recording apparatus.

BACKGROUND

In a known image recording apparatus, a plurality of recording units is arranged in the vertical direction in a housing. A sheet conveyed from a supply tray passes below each recording unit. Each recording unit ejects ink to a sheet that passes below the recording unit. The sheets having passed below a plurality of recording heads are discharged to discharge trays.

SUMMARY

According to one aspect, this specification discloses an image recording apparatus. The image recording apparatus includes a housing, a first print engine, and a second print engine. A first conveyance path and a second conveyance path are formed in the housing. The first conveyance path extends in a conveyance direction to reach a first discharge port for discharging a sheet. The second conveyance path extends in the conveyance direction at a position higher than the first conveyance path to reach a second discharge port for discharging a sheet. The second discharge port is located at a position upstream of the first discharge port in the conveyance direction. The first print engine is provided at the first conveyance path. The first print engine is configured to print an image by using a recording agent on a sheet conveyed along the first conveyance path. The second print engine is provided at the second conveyance path. The second print engine is configured to print an image by using a recording agent on a sheet conveyed along the second conveyance path.

BRIEF DESCRIPTION OF THE DRAWINGS

Embodiments in accordance with this disclosure will be described in detail with reference to the following figures wherein:

FIG. 4A shows the discharge tray 420B separated from a mount position P2*b* and FIG. 4B shows the discharge tray 420B located at the mount position P2*b;*

FIG. 7A shows the slide member 571R located at a rear position P6*b* and FIG. 7B shows the slide member 571R located at a front position P7*b;*

FIG. 8A shows the lever 572R located at a reference position P8*b* and FIG. 8B shows the lever 572R located at a forward rotation position P9*b;*

DETAILED DESCRIPTION

Figure 1A:
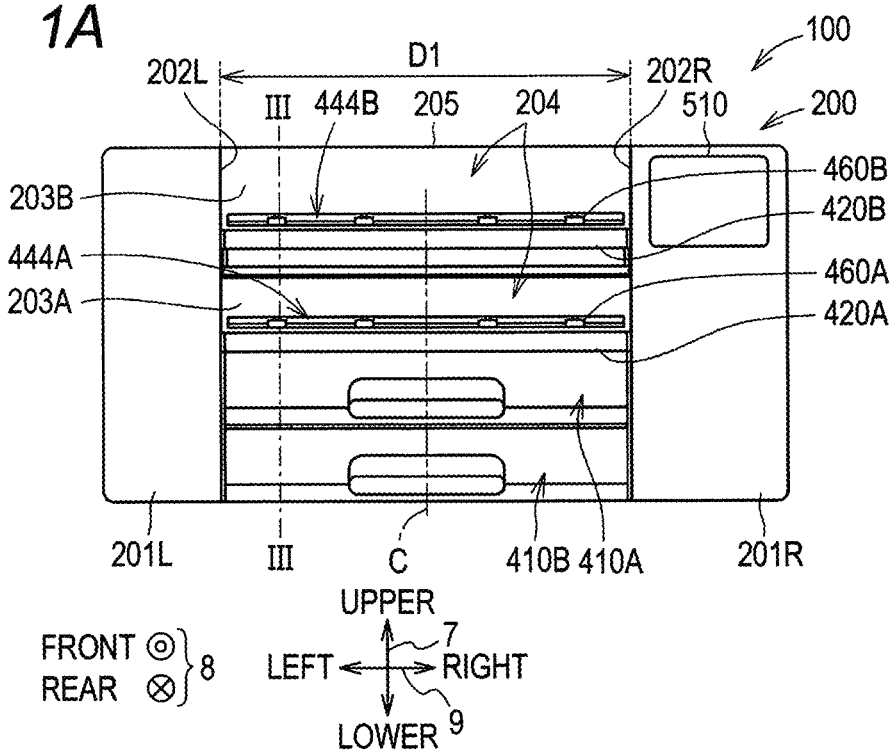
FIG. 1A is a front view schematically showing a printer 100.

In the image recording apparatus, when a jam occurs below each recording unit, the jam processing can be performed only from the front-rear direction of the housing. Thus, it may be difficult to remove the sheet or sheet piece that is clogged under the recording unit.

In view of the foregoing, an aspect of an objective of this disclosure is to provide an image recording apparatus in which jam processing is performed easily.

Hereinafter, embodiments of the present disclosure will be described with reference to the drawings as appropriate. The embodiments described below are merely examples of the present disclosure, and the embodiments can be appropriately changed without departing the scope of the claims. In the following description, a vertical direction 7 is defined based on the installation state (the state of FIGS. 1A to 2) in which a printer 100 is usable, a front-rear direction 8 is defined with a surface having an opening 207 as the front side, and a left-right direction 9 is defined when the printer 100 is viewed from the front side. The vertical direction 7, the front-rear direction 8 and the left-right direction 9 are perpendicular to each other. In the following description, the direction from the start point to the end point of an arrow is expressed as an orientation, and the line connecting the start point and the end point of the arrow is expressed as the direction. In other words, an orientation is a component of a direction.

[Schematic Configuration of Printer 100]

Figure 1B:
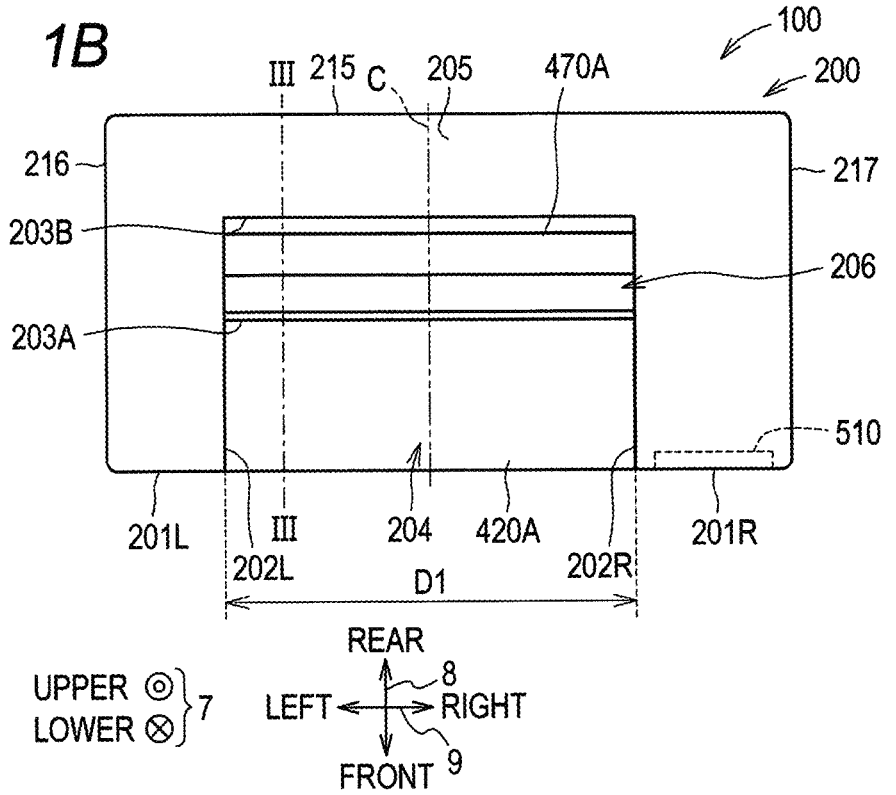
FIG. 1B is a top view schematically showing the printer 100.
Figure 2:
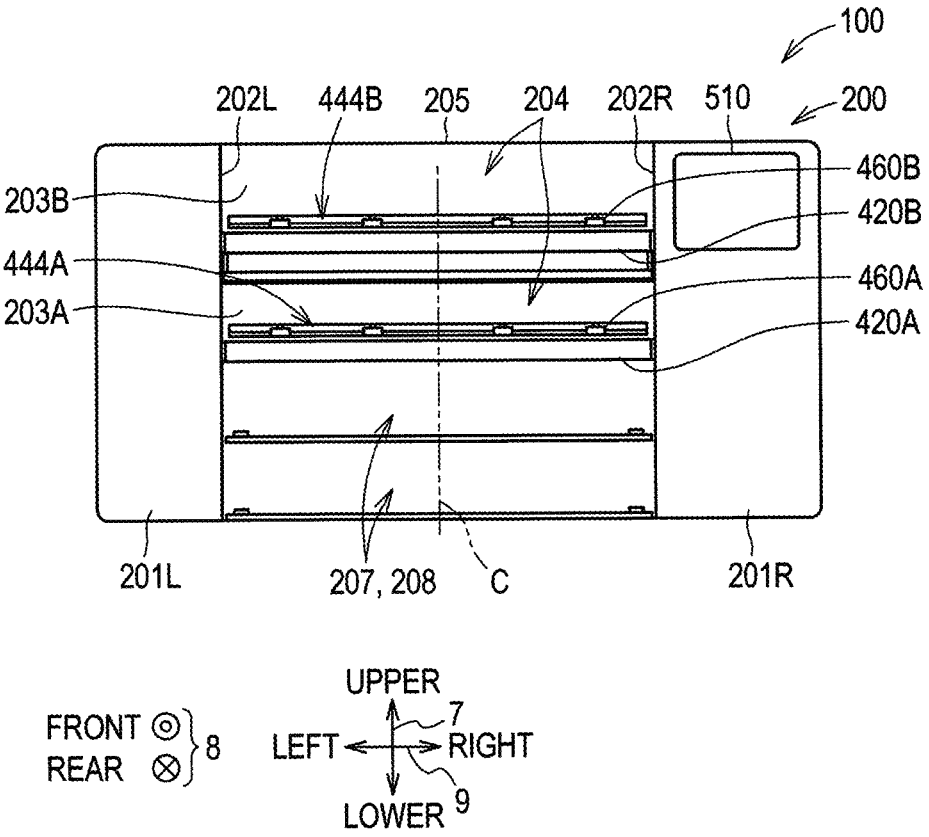
FIG. 2 is a front view schematically showing an opening 207 of a housing 200 of FIGS. 1A and 1B.

As shown in FIGS. 1A to 2, a printer 100 includes a housing 200, supply trays 410A and 410B, discharge trays 420A and 420B, discharge rollers 460A and 460B, and a display 510.

Figure 3:
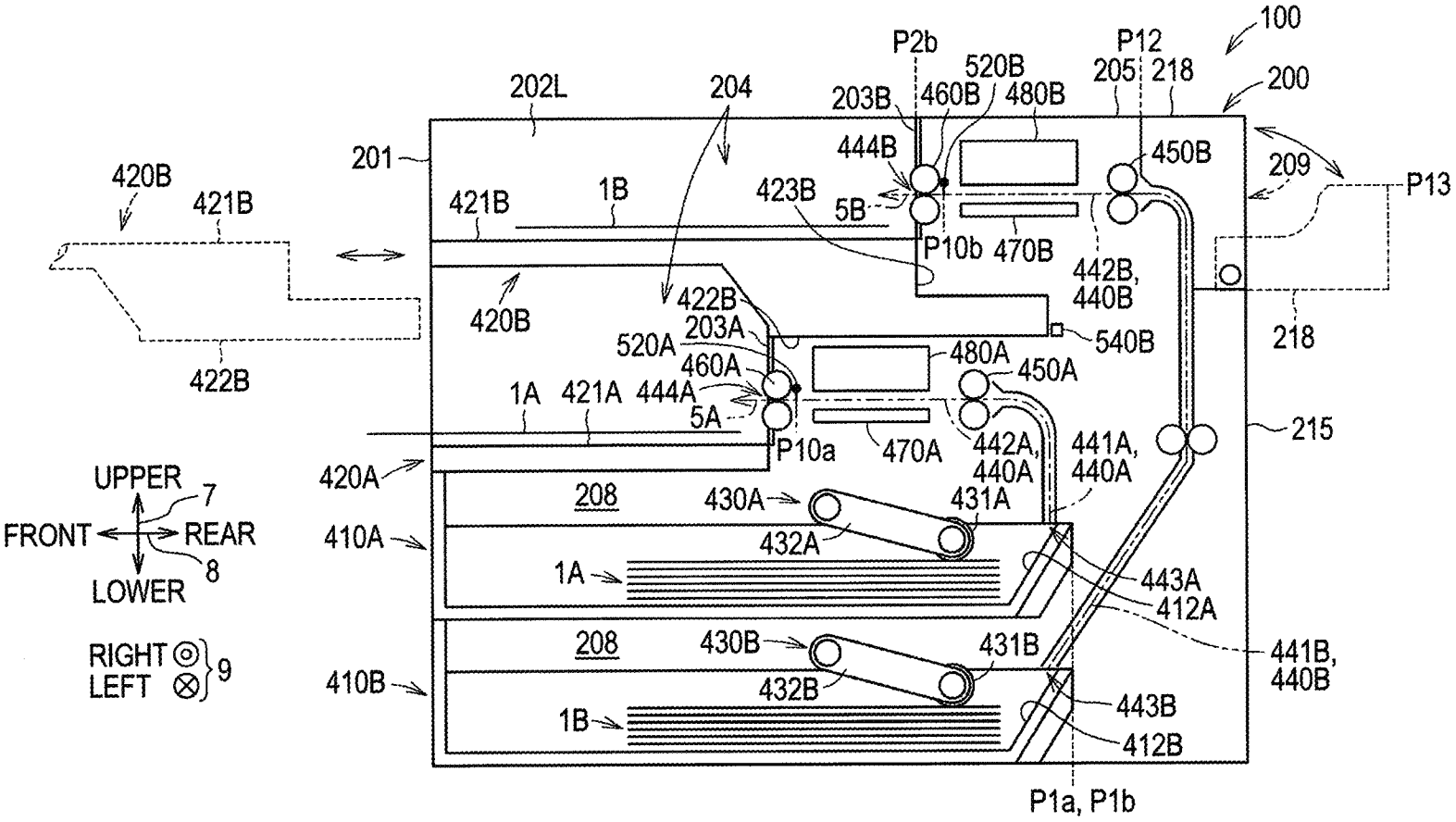
FIG. 3 is a schematic view of a vertical cross section of the printer 100 along a single-dot chain line in FIGS. 1A and 1B when viewed from the right.

As shown in FIG. 3, the printer 100 further includes feed mechanisms 430A and 430B, conveyance roller pairs 450A and 450B, platens 470A and 470B, and recording heads 480A and 480B. Conveyance paths 440A and 440B are formed in the housing 200.

As shown in FIGS. 6 to 8B, the printer 100 further includes a nip release mechanism 570.

Figure 9:
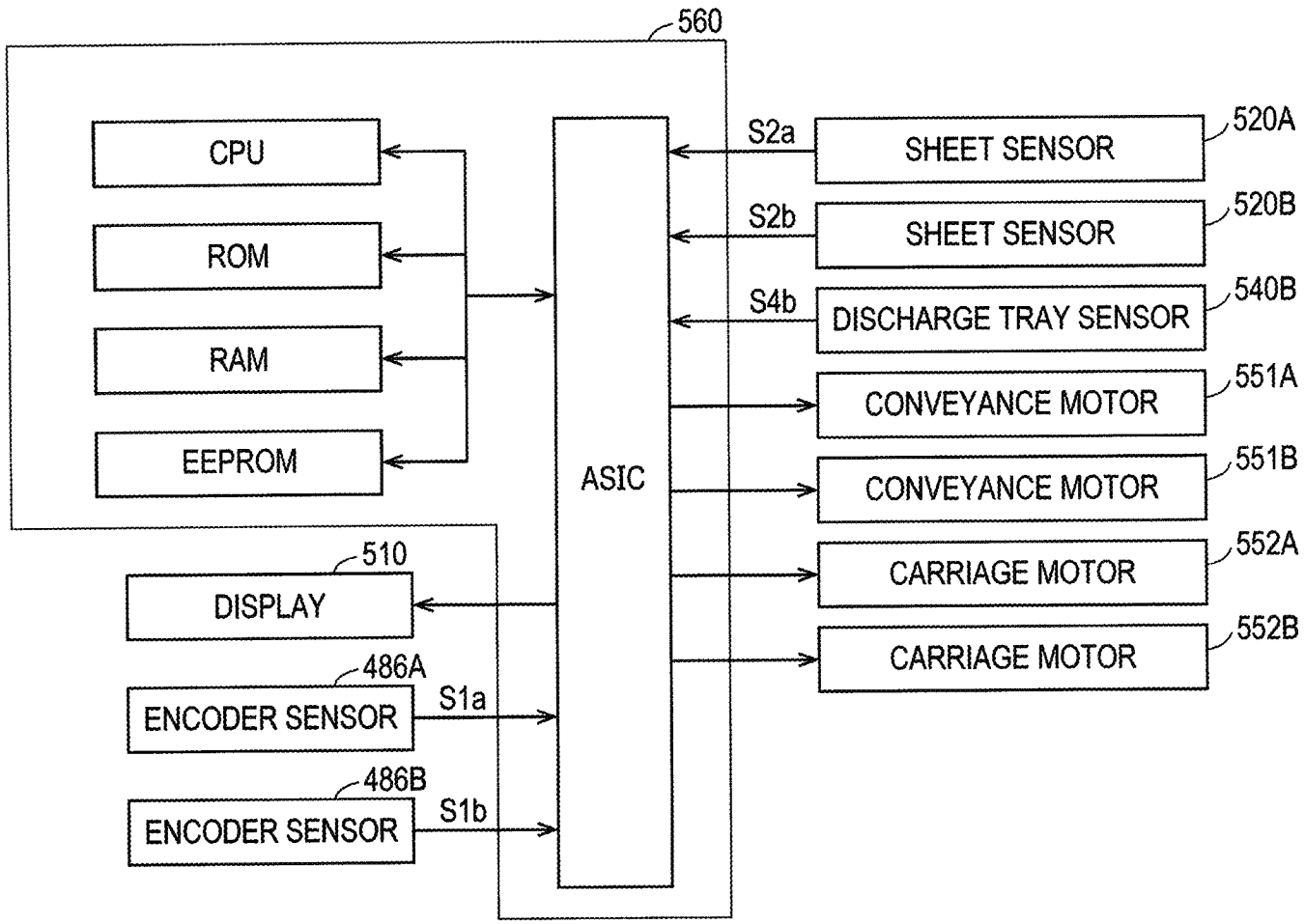
FIG. 9 is a block diagram showing the configuration of the printer 100.

As shown in FIG. 9, the printer 100 further includes sheet sensors 520A and 520B, a discharge tray sensor 540B, conveyance motors 551A and 551B, carriage motors 552A and 552B, encoder sensors 486A and 486B, and a controller 560.

The printer 100 is an example of an image recording apparatus.

The supply trays 410A and 410B are examples of an upper supply tray (first supply tray) and a lower supply tray (second supply tray), respectively. The discharge trays 420A and 420B are examples of a lower discharge tray (first discharge tray) and an upper discharge tray (second discharge tray). The conveyance paths 440A and 440B are examples of a lower conveyance path (first conveyance path) and an upper conveyance path (second conveyance path), respectively. The recording head 480A is an example of a lower print engine (first print engine). The first print engine is configured to print an image by using a recording agent (ink, toner, and so on) on a sheet conveyed along the first conveyance path. The recording head 480B is an example of an upper print engine (second print engine). The second print engine is configured to print an image by using a recording agent on a sheet conveyed along the second conveyance path. The conveyance roller pairs 450A and 450B are examples of a lower conveyance roller pair (conveyance roller pair) and an upper conveyance roller pair (conveyance roller pair), respectively.

[Housing 200]

In FIGS. 1A to 2, the housing 200 is an exterior body having a substantially rectangular parallelepiped outer shape, and is supported by various frames (not shown) in the housing 200. The housing 200 includes a left front wall 201L, a right front wall 201R, a left inner side wall 202L, a right inner side wall 202R, a lower back wall 203A, and an upper back wall 203B.

As shown in FIGS. 1A and 1B, each of the left front wall 201L and the right front wall 201R has a substantially rectangular shape that is long in the vertical direction 7 in the front view. The left front wall 201L is located at a distance D1 to the left from the right front wall 201R. The distance D1 is substantially equal to the left-right sizes of the supply tray 410A and so on.

The left inner side wall 202L extends rearward from the right end of the left front wall 201L. The right inner side wall 202R extends rearward from the left end of the right front wall 201R. Each of the left inner side wall 202L and the right inner side wall 202R extends in both the vertical direction 7 and the front-rear direction 8.

In FIG. 1A, each of the lower back wall 203A and the upper back wall 203B has a substantially rectangular shape which is long in the left-right direction 9 in the front view, and connects the rear ends of the left inner side wall 202L and the right inner side wall 202R. The lower back wall 203A is located at a farther lower and forward position than the upper back wall 203B.

As shown in FIG. 1B, the portion between the upper end of the lower back wall 203A and the lower end of the upper back wall 203B is an opening 206 that opens upward. When the discharge tray 420B is removed, at least the platen 470A (see FIG. 5) is exposed through the opening 206.

Figure 4A:
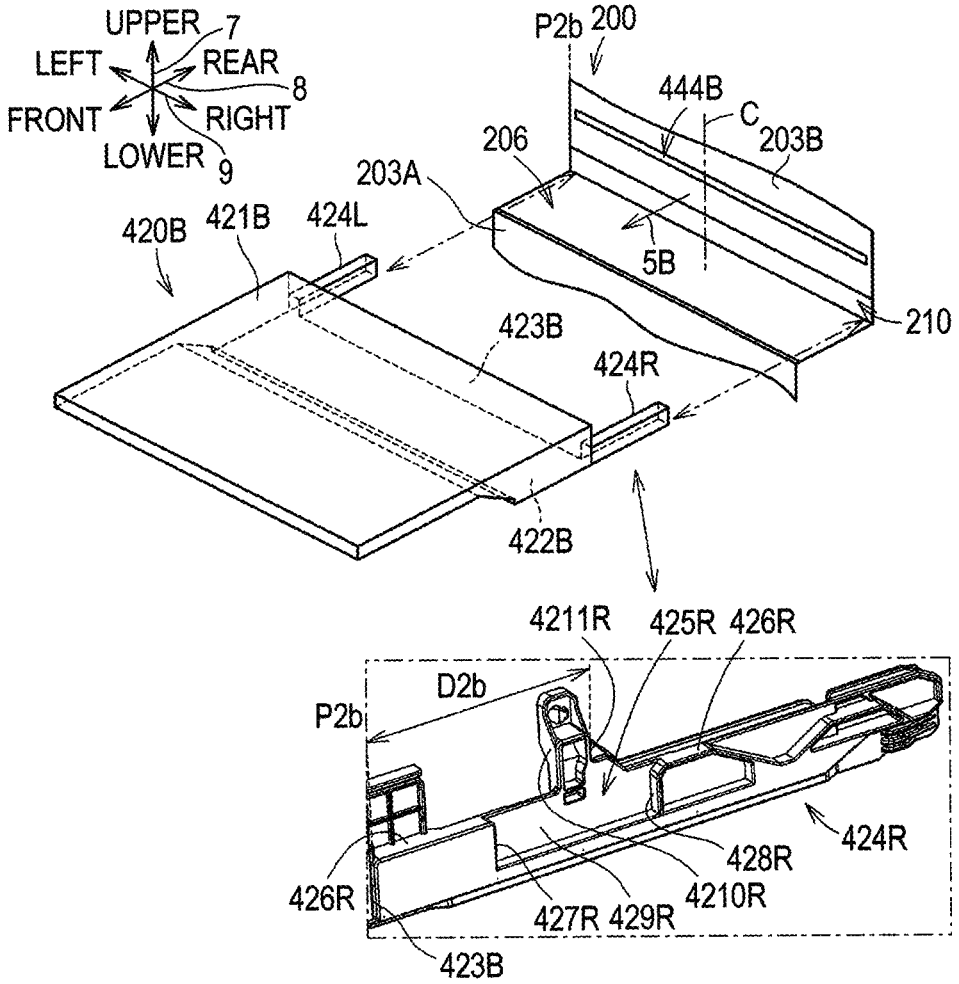
FIGS. 4A and 4B are perspective views schematically showing a discharge tray 420B of FIG. 1A, where
Figure 4B:
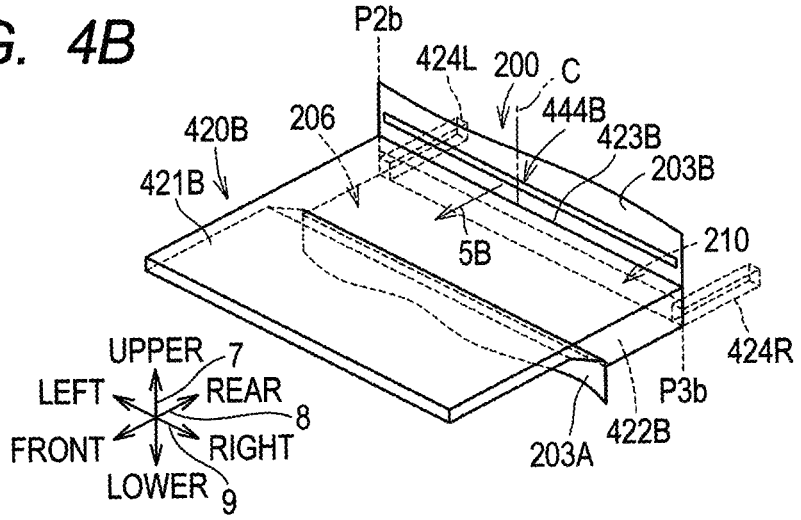

In the front view, the portion between the upper back wall 203B and the lower back wall 203A is an opening 210 (see FIGS. 4A and 4B). In FIG. 1A, the opening 210 is hidden at the rear of the discharge tray 420B.

In FIG. 1A, slits elongated in the left-right direction 9 are formed as discharge ports 444A and 444B at positions near the lower ends of the lower back wall 203A and the upper back wall 203B, respectively. In the front view, parts of the discharge rollers 460A and 460B are seen through the discharge ports 444A and 444B, respectively. The discharge port 444A is an example of a lower discharge port (first discharge port), and the discharge port 444B is an example of an upper discharge port (second discharge port).

In FIGS. 1A and 1B, the left inner side wall 202L, the right inner side wall 202R, the lower back wall 203A, and the upper back wall 203B define an installation space 204 of the discharge trays 420A and 420B. The installation space 204 is open both forward and upward. The discharge tray 420A defines the lower end of the installation space 204. Note that in FIG. 1B, the discharge tray 420B is not shown.

The housing 200 further includes an upper wall 205. The upper wall 205 is connected to the upper ends of the left front wall 201L, the right front wall 201R, the left inner side wall 202L, the right inner side wall 202R, and the upper back wall 203B.

As shown in FIG. 2, in the housing 200, the portion below the discharge tray 420A is an opening 207 that is open toward the front. A housing space 208 of the supply trays 410A and 410B extends from the opening 207 toward the inside (that is, rearward) of the housing 200.

As shown in FIG. 1B, the housing 200 further includes a rear wall 215. The rear wall 215 connects the rear ends of the upper wall 205, the left outer wall 216, and the right outer wall 217 of the housing 200 to each other. In the rear wall 215, an opening 209 (see FIG. 3) opened rearward is formed rearward of the conveyance roller pair 450 described later, so that the user can access the conveyance roller pair 450.

As shown in FIG. 3, the housing 200 further includes a cover 218. The cover 218 is rotatably movable about an axis extending along the left-right direction 9 between a closed position P12 for closing the opening 209 of the rear wall 215 and an open position P13 for opening the opening 209 of the rear wall 215. When the cover 218 is in the open position P13, the user can access the conveyance roller pair 450 and remove the sheet 1B jammed in the conveyance path 440B.

[Display 510]

The display 510 is located near the upper end of the right front wall 201R. The display 510 displays various images based on the image data transmitted by the controller 560. The display 510 may be provided at another position on the housing 200.

[Supply Trays 410A and 410B]

As shown in FIG. 3, the supply trays 410A and 410B are mounted in the housing space 208 through the opening 207 (see FIG. 2). The supply tray 410A is mounted above the supply tray 410B.

Each of the supply trays 410A and 410B has a box-like shape which is thin in the vertical direction 7. The upper ends of the supply trays 410A and 410B are open. The first supply tray 410A has a guide surface 412A at the rear end thereof. The guide surface 412A is inclined upward toward the rear so as to guide the sheet 1A fed by a feed roller 431A (described later) toward the conveyance path 440A (curved portion 441A). The second supply tray 410B has a guide surface 412B at the rear end thereof. The guide surface 412B is inclined upward toward the rear so as to guide the sheet 1B fed by a feed roller 431B (described later) toward the conveyance path 440B (curved portion 441B). In this embodiment, the guide surface 412A and the guide surface 412B are located at the same position in the front-rear direction 8, and the feed roller 431A and the feed roller 431B are located at the same position in the front-rear direction 8. As shown in FIG. 3, the supply trays 410A and 410B are configured to support a plurality of sheets 1A and 1B in a stacked state at the bottom thereof. The size and type of the sheet 1B may be the same as or different from that of the sheet 1A. The sheets 1A and 1B are supported by sheet guides (not shown) provided at the bottoms of the supply trays 410A and 401B such that the centers of the sheets 1A and 1B in the width direction are aligned with a paper passage center plane C. As shown in FIGS. 1A to 2, the paper passage center plane C is a plane that passes substantially through the center of the discharge ports 444A and 444B in the left-right direction 9 and that is parallel to the vertical direction 7 and the front-rear direction 8. The paper passage center plane C is also a plane that passes through the approximate center of the conveyance paths 440A and 440B (see FIG. 3) described later in the left-right direction 9.

[Discharge Trays 420A and 420B]

As shown in FIG. 3, the discharge tray 420A extends forward from immediately below the discharge port 444A of the conveyance path 440A at the lower end of the installation space 204. The discharge tray 420A has a support surface 421A that extends in the front-rear direction 8 and the left-right direction 9.

The discharge tray 420B is mounted at a mount position P2*b* (see FIGS. 3, 4A, and 4B) in the installation space 204 by moving rearward (an example of a mount direction) while being guided along guide rails (not shown) provided at the left inner side wall 202L and the right inner side wall 202R at a position separated above the discharge tray 420A in the installation space 204. The mount position P2*b* is, for example, the position of the upper back wall 203B in the front-rear direction 8. The discharge tray 420B at the mount position P2*b* has a support surface 421B extending forward from immediately below the discharge port 444B of the conveyance path 440B and extending in the front-rear direction 8 and the left-right direction 9. The mount position P2*b* is an example of a mount position.

The discharge tray 420B is removed from the housing 200 by moving forward (an example of a separation direction) from the mount position P2*b* while being guided on the guide rail.

Each of the support surfaces 421A and 421B has a substantially rectangular shape in a plan view, and supports the sheets 1A and 1B discharged from the discharge ports 444A and 444B.

In FIGS. 4A and 4B, the discharge tray 420B further has a lower end surface 422B. The lower end surface 422B has a rectangular shape having a size slightly larger than the opening 206 in a plan view from below. The lower end surface 422B moves rearward (an example of a closing direction) in conjunction with the rearward movement of the discharge tray 420B toward the mount position P2*b* (see FIG. 4B). The lower end surface 422B is located at a closed position P3*b* when the discharge tray 420B is located at the mount position P2*b*. The closed position P3*b* is a position where the lower end surface 422B closes the opening 206 (that is, above a straight portion 442A of the conveyance path 440A). The lower end surface 422B is an example of a cover. When the discharge tray 420B moves forward from the mount position P2*b*, the lower end surface 422B moves forward (an example of an opening direction) from the closed position P3*b* to open the opening 206 (see FIG. 4A).

Joints 424L and 424R, which are a part of a nip release mechanism 570 described later, extend rearward from the left and right ends of the rear end surface 423B of the discharge tray 420B.

As shown in FIG. 4A, specifically, the joint 424R extends from the right end of the rear end surface 423B. The joint 424R has a plate-like shape that is long in the front-rear direction 8 and thin in the left-right direction 9. In the lower right part of FIG. 4A, the joint 424R is shown in more detail.

The joint 424R has a concave portion 425R. The concave portion 425R is located near the front end of the joint 424R. The concave portion 425R is recessed downward from an upper surface 426R of the joint 424R, and is recessed leftward from the right end of the joint 424R. That is, the front end, the rear end, and the left end of the concave portion 425R are defined by a front surface 427R, a rear surface 428R, and a left surface 429R, respectively. The front surface 427R and the rear surface 428R each have a substantially rectangular shape elongated in the vertical direction 7, and face each other in the front-rear direction 8. The left surface 429R has a substantially rectangular shape when viewed from the right side, and connects the left ends of the front surface 427R and the rear surface 428R.

The joint 424R has a protrusion 4210R on the upper surface 426R immediately to the left of the concave portion 425R. The protrusion 4210R extends upward from a particular position on the upper surface 426R. The particular position is an approximately intermediate position between the front surface 427R and the rear surface 428R in the concave portion 425R in the front-rear direction 8. The protrusion 4210R has a substantially rectangular parallelepiped shape elongated in the vertical direction 7, and has a rear surface 4211R. The rear surface 4211R is located at a distance D2*b* from the rear end surface 423B of the discharge tray 420B.

The joint 424R is inserted into the housing 200 through the opening 210 in the process in which the lower end surface 422B moves to the closed position P3*b*. Details will be described later, but in the housing 200, the tip of a lever 572R enters the concave portion 425R, and a protrusion 578R of a slide member 571R contacts the protrusion 4210R.

Since the joint 424L may have a shape symmetrical to the joint 424R with respect to the paper passage center plane C, a detailed description of the joint 424L will be omitted. In the specification and the drawings, a sign "L" may be added to a reference sign of a left-side part with respect to the paper passage center plane C, and a sign "R" may be added to a reference sign of a right-side part with respect to the paper passage center plane C.

[Feed Mechanisms 430A and 430B]

As shown in FIG. 3, the feed mechanism 430A is located in the housing 200 between the supply tray 410A and the platen 470A in the vertical direction 7. The feed mechanism 430A generally includes a feed roller 431A and a feed arm 432A, and transmits the driving force of the conveyance motor 551A (see FIG. 9) to the feed roller 431A by a drive transmission mechanism (not shown) housed in the feed arm 432A. As a result, the feed roller 431A rotates forward and feeds the uppermost sheet 1A on the supply tray 410A to the supply port 443A of the conveyance path 440A.

The feed mechanism 430B is located in the housing 200 between the supply tray 410A and the supply tray 410B at a mount position P1*b* in the vertical direction 7. The feed mechanism 430B generally includes a feed roller 431B and a feed arm 432B, is rotated by the driving force of the conveyance motor 551B (see FIG. 9), and feeds the uppermost sheet 1B on the supply tray 410B to the supply port 443B of the conveyance path 440B.

[Conveyance Paths 440A and 440B]

As shown in FIG. 3, the conveyance paths 440A and 440B are formed in the housing 200 from the supply ports 443A and 443B to the discharge ports 444A and 444B while curving, respectively.

The conveyance path 440A is shown by a single-dot chain line in FIG. 3, and has a curved portion 441A and a straight portion 442A. The curved portion 441A has a supply port 443A. The supply port 443A is located immediately above the rear end of the supply tray 410A in the housing 200. The curved portion 441A extends upward from the supply port 443A while curving to extend forward. The straight portion 442A is continuous with the downstream end of the curved portion 441A, and extends substantially linearly forward from the downstream end of the curved portion 441A to reach the discharge port 444A.

The conveyance path 440B is indicated by a double-dot chain line in FIG. 3, and has a curved portion 441B and a straight portion 442B. The curved portion 441B has a supply port 443B. The supply port 443B is located immediately above the rear end of the supply tray 410B in the housing 200. The curved portion 441B extends upward from the supply port 443B while passing the outside of the curved portion 441A in the housing 200. The curved portion 441B bends forward at a higher position than the conveyance path 440A. The straight portion 442B is continuous with the downstream end of the curved portion 441B, extends substantially linearly forward from the downstream end of the curved portion 441B, and passes above the straight portion 442A to reach the discharge port 444B. The discharge port 444B is located at a farther rearward position than the discharge port 444A in the front-rear direction 8.

In the conveyance paths 440A and 440B, the sheets 1A and 1B are conveyed in conveyance directions 5A and 5B, respectively.

[Conveyance Roller Pairs 450A and 450B]

As shown in FIG. 2, the conveyance roller pair 450A has a pair of two rollers that contact each other at the position of the downstream end of the curved portion 441A (that is, the upstream end of the straight portion 442A). One of the two rollers extends in the left-right direction 9 along the conveyance path 440A below the conveyance path 440A. The one of the two rollers is rotated by the driving force generated by the conveyance motor 551A (see FIG. 9). The other of the two rollers contacts the one roller from above and is rotated by following the rotation of the one roller.

The conveyance roller pair 450B is the same as the conveyance roller pair 450A except that the conveyance roller pair 450B is located at the downstream end of the curved portion 441B (that is, the upstream end of the straight portion 442B). A detailed description of the conveyance roller pair 450B will be given later.

By rotating, the conveyance roller pairs 450A and 450B nip the sheets 1A and 1B which are conveyed along the curved portions 441A and 441B and send the same out to the straight portions 442A and 442B, respectively.

[Discharge Roller Pairs 460A and 460B]

As shown in FIGS. 2 and 3, the discharge roller pair 460A has two rollers that contact each other at a position between the platen 470A and the discharge port 444A in the straight portion 442A in the housing 200. One of the two rollers extends in the left-right direction 9 along the conveyance path 440A below the conveyance path 440A. The one of the two rollers is rotated by the driving force generated by the conveyance motor 551A (see FIG. 9). The other of the two rollers is a spur, which contacts the one roller from above and is rotated by following the rotation of the one roller.

The discharge roller pair 460B is the same as the discharge roller pair 460A except that the discharge roller pair 460B is located between the platen 470B and the discharge port 444B in the straight section 442B in the housing 200. Thus, a detailed description of the discharge roller pair 460B will be omitted. As shown in FIG. 3, the conveyance roller pair 450A provided at the conveyance path 440A is located between the discharge roller pair 460B and the conveyance roller pair 450B provided at the conveyance path 440B in the conveyance direction 5A, 5B (in the front-rear direction 8).

By rotating, the discharge roller pairs 460A and 460B nip the sheets 1A and 1B which are conveyed along the straight portions 442A and 442B and send the same out to the discharge ports 444A and 444B, respectively.

[Platens 470A and 470B]

Figure 5:
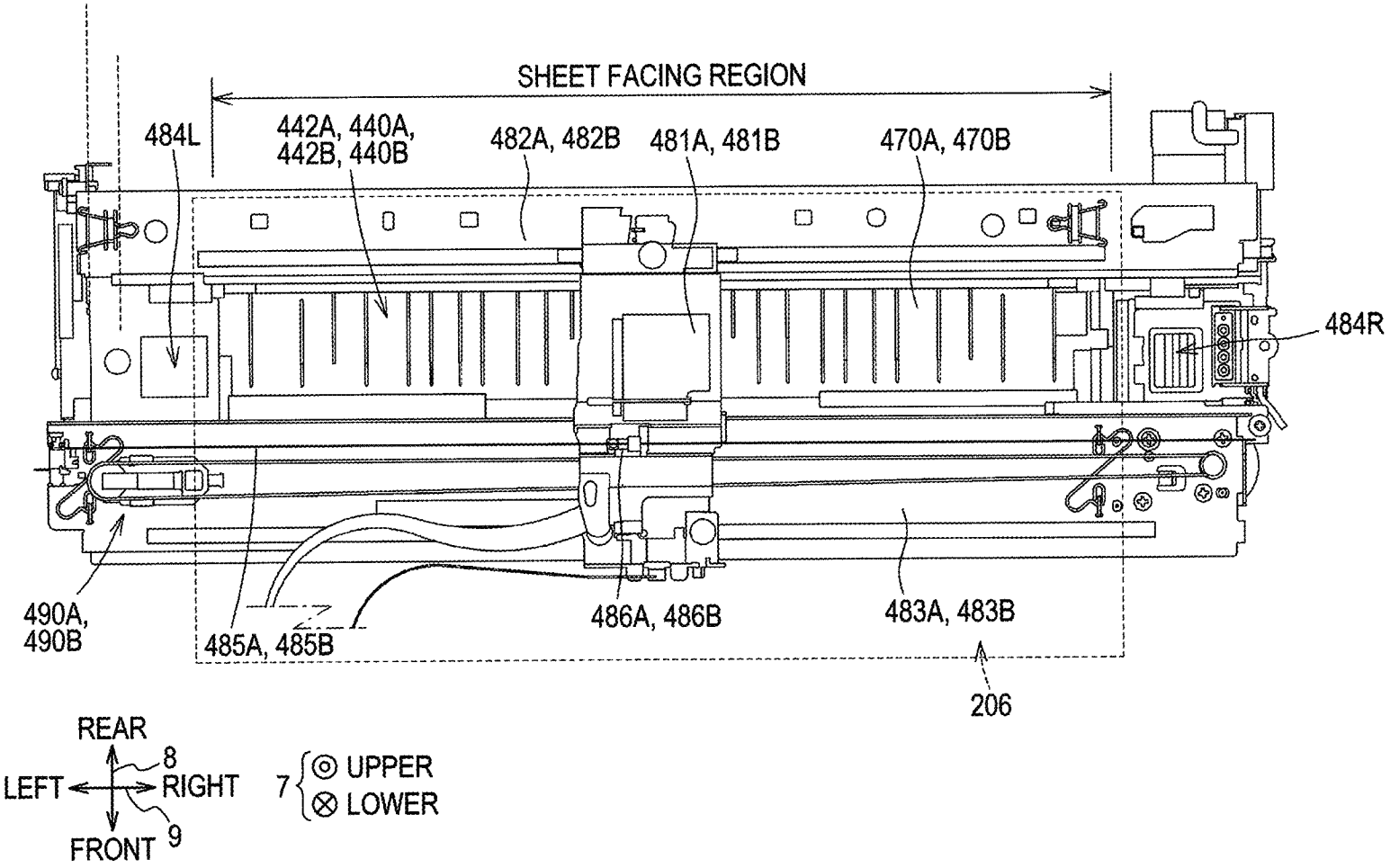
FIG. 5 is a schematic view showing a platen 470A of FIG. 3 and an opening 206.

In FIG. 3, the platen 470A is located between the conveyance roller pair 450A and the discharge roller pair 460A in the conveyance direction 5A. As shown in FIG. 3, the platen 470A is located below the opening 206. And, as shown in FIG. 5, the platen 470A is exposed through the opening 206 when the discharge tray 420B is removed.

The platen 470B is located between the conveyance roller pair 450B and the discharge roller pair 460B in the conveyance direction 5B and farther rearward than the platen 470A in the front-rear direction 8.

The platens 470A and 470B support the sheets 1A and 1B conveyed along the straight portions 442A and 442B with the support surfaces that extend in the front-rear direction 8 and the left-right direction 9 directly below the straight portions 442A and 442B, respectively.

[Recording Heads 480A and 480B]

As shown in FIG. 3, the recording heads 480A and 480B are located slightly upward from the platens 470A and 470B in the vertical direction 7, respectively. The recording head 480B is located at a position shifted rearward from the recording head 480A in the front-rear direction 8. That is, the recording head 480B is located at a position upstream of the recording head 480A in the conveyance direction 5A, 5B. When viewed in the vertical direction 7, the recording head 480B does not overlap the recording head 480A. However, when viewed in the vertical direction 7, the recording head 480B may partially overlap the recording head 480A.

The recording heads 480A and 480B eject ink to the sheets 1A and 1B supported by the platens 470A and 470B, respectively. As a result, an image is recorded on each of the sheets 1A and 1B. In the present embodiment, each of the recording heads 480A and 480B is a serial head. The recording heads 480A and 480B record an image by an inkjet method. Alternatively, an image may be recorded by a thermal transfer method and so on.

The recording head 480A is mounted on the lower surface side of the carriage 481A shown in FIG. 5. In FIG. 5, the recording head 480A is hidden by the carriage 481A.

In FIG. 5, the carriage 481A is supported by guide rails 482A and 483A extending in the left-right direction 9 at positions separated from each other in the front-rear direction 8. The carriage 481A is connected to a known belt mechanism 490A (an example of a lower drive mechanism) arranged on the guide rail 483A. The belt mechanism 490A is driven by a carriage motor 552A (see FIG. 9). The belt mechanism 490A circularly moves by driving of the carriage motor 552A. Together with the recording head 480A, the carriage 481A connected to the belt mechanism 490A is configured to reciprocate in the left-right direction 9 (an example of an intersecting direction) in a sheet facing region (an example of a lower print position (print position)) above the straight portion 442A of the conveyance path 440A on the platen 470A. The recording head 480A ejects ink while the carriage 481A is moving in the sheet facing region. Specifically, the carriage 481A is movable between a retracted position 484L and a retracted position 484R in the left-right direction 9. The retracted positions 484L and 484R are leftward and rightward regions of the sheet facing region. The retracted positions 484L and 484R are also regions for performing various maintenance operations (flushing, purging, and so on) on the recording head 480A.

In FIG. 5, a strip-shaped encoder strip 485A extending in the left-right direction 9 is arranged at the guide rail 483A. The encoder sensor 486A is mounted on the carriage 481A so as to face the encoder strip 485A. While the carriage 481A is moving in the left-right direction 9, the encoder sensor 486A reads the encoder strip 485A to generate a pulse signal Sla, and outputs the generated pulse signal Sla to the controller 560 (see FIG. 9).

The carriage 481A, the guide rails 482A, 483A, the belt mechanism, the carriage motor 552A (see FIG. 9), the encoder strip 485A, and the encoder sensor 486A are an example of a lower drive mechanism (drive mechanism).

As shown in FIG. 5, in a similar manner to the recording head 480A, the recording head 480B is movable in the left-right direction 9 by a carriage 481B, guide rails 482B and 483B, a belt mechanism, the carriage motor 552B (see FIG. 9), an encoder strip 485B, and the encoder sensor 486B. In the following, the pulse signal output by the encoder sensor 486B is designated by a reference sign "S1*b*".

[Nip Release Mechanism 570]

Figure 6:
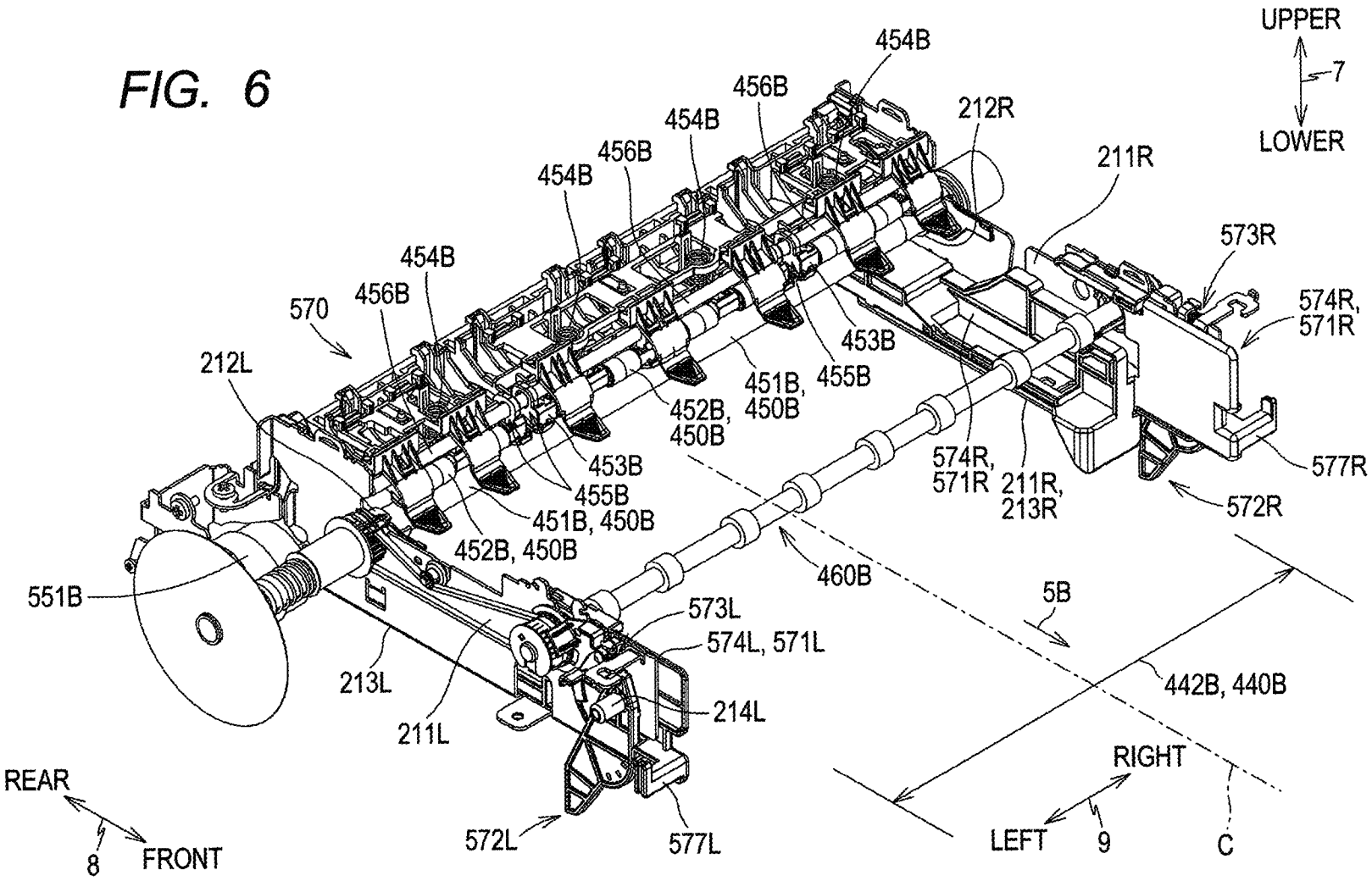
FIG. 6 is a perspective view showing a part of a nip release mechanism 570.
Figure 7A:
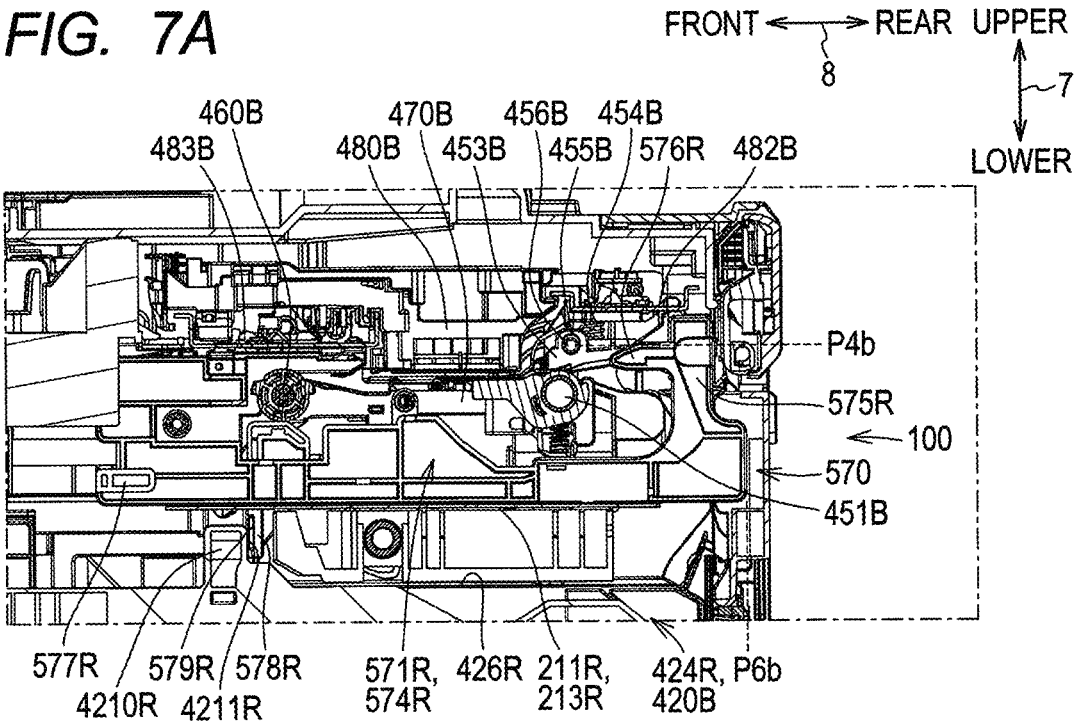
FIGS. 7A and 7B are vertical cross-sectional views showing a slide member 571R of the nip release mechanism 570, where
Figure 7B:
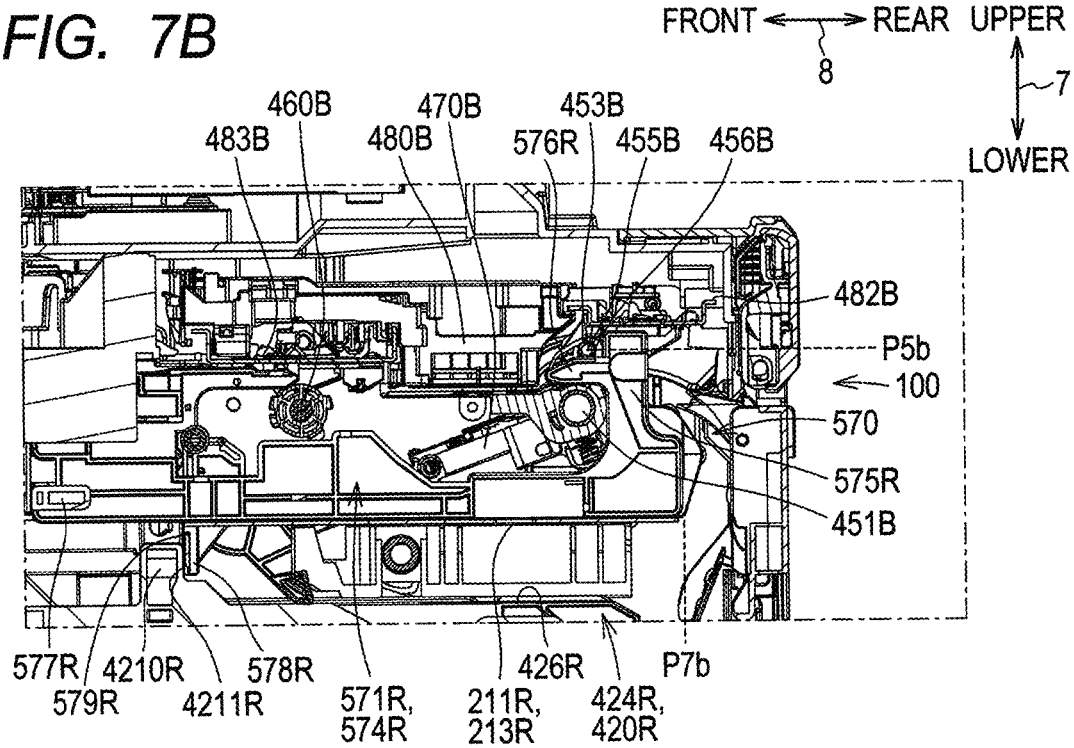

In FIGS. 6, 7A and 7B, the nip release mechanism 570 roughly includes roller holders 453B, a plurality of coil springs 454B, release shafts 456B, a pair of slide members 571L, 572R, a pair of levers 572A, 572R, and a pair of coil springs 573L, 573R.

[Roller Holders 453B, Coil Springs 454B, Release Shafts 456B]

With reference to FIG. 6, the conveyance roller pair 450B is first described in more detail. The conveyance roller pair 450B includes a drive roller 451B and a plurality of pinch rollers 452B as a pair of rollers. The drive roller 451B extends in the left-right direction 9 along the conveyance path 440B below the conveyance path 440B. The drive roller 451B is provided to bridge between a pair of side frames 211L, 211R. The side frames 211L, 211R extend in the front-rear direction 8 at positions further to the left and to the right than the straight portion 442B in the housing 200. The drive roller 451B is rotatably supported by bearings 212L, 212R provided on the side frames 211L, 211R. The side frames 211L, 211R may have symmetrical shapes in the left-right direction 9 with respect to the paper passage center plane C.

As shown in FIG. 6, each of the plurality of pinch rollers 452B is rotatably supported by the roller holder 453B. The plurality of coil springs 454B are located immediately above the roller holder 453B. Each coil spring 454B is connected to the roller holder 453B at the lower end in a length direction thereof and connected to the lower surface of the guide rail 482B (see FIG. 5) at the upper end thereof. Specifically, the roller holder 453B is supported on the guide rail 482B via the plurality of coil springs 454B and urged downward by the plurality of coil springs 454B. In this way, each pinch roller 452B in the roller holder 453B is urged toward the drive roller 451B.

A part of each roller holder 453B above the pinch roller 452B is formed with a through hole 455B penetrating through the roller holder 453B in the left-right direction 9. The release shaft 456B extending in the left-right direction 9 is inserted into each through hole 455B. The release shaft 456B is provided to bridge between the side frames 211L, 211R, and the right and left ends of the release shaft 456B are supported on the side frames 211L, 211R. In this way, when an upward external force is applied to the release shaft 456B, the roller holder 453B is movable in the vertical direction 7 with respect to the side frames 211L, 211R together with each pinch roller 452B against an urging force of each coil spring 454B.

In particular, the release shaft 456B is movable between a nip position P4*b* (see FIG. 7A) and a separation position P5*b* (see FIG. 7B). The release shaft 456B is an example of an upper separation member (separation member). The nip position P4*b* and the separation position P5*b* are examples of a first contact position (contact position) and a first separation position (separation position), respectively. When no upward external force is applied to the release shaft 456B, the release shaft 456B is located at the nip position P4*b* by the urging force exerted by the coil spring 454B. The nip position P4*b* is a position of the release shaft 456B where each pinch roller 452B (see FIG. 6) is in contact with the drive roller 451B. When an upward force is applied to the release shaft 456B by a protrusion 576R described later, the release shaft 456B moves to the separation position P5*b* separated upward from the nip position P4*b* against the urging force of the coil spring 454B. As a result, a gap is formed between each pinch roller 452B and the drive roller 451B.

[Slide Members 571R and 571L]

As shown in FIG. 6, the slide member 571R is supported by a bottom portion 213R extending in the front-rear direction 8 at the lower end of the side frame 211R. As shown in FIGS. 7A and 7B, the bottom portion 213R is located above the joint 424R of the discharge tray 420B at the mount position P2*b*. The slide member 571R is slidable in the front-rear direction 8 along the bottom portion 213R at the left of the side frame 211R. The slide member 571R moves between a rear position P6*b* (see FIG. 7A) and a front position P7*b* (see FIG. 7B) in the front-rear direction 8. The slide member 571R is located at the rear position P6*b* when the discharge tray 420B is at the mount position P2*b*, and is located at the front position P7*b* in the process in which the discharge tray 420B is pulled out from the housing 200.

As shown in FIGS. 6, 7A and 7B, the slide member 571R roughly includes a main body 574R, an extension portion 575R integrally provided with the main body 574R, the protrusion 576R, a protruding portion 577R, and a protrusion 578R.

As shown in FIGS. 7A and 7B, the extension portion 575R extends upward from a rear end of the main body 574R. The protrusion 576R protrudes forward from an extending end of the extension portion 575R. The protrusion 576R has a tapered shape. In particular, the upper surface of the protrusion 576R is inclined downward toward the front, that is, toward the tip.

As shown in FIG. 7A, the tip of the protrusion 576R is provided substantially at the same position as the lower end of the release shaft 456B at the nip position P4*b* in the vertical direction 7. The tip of the protrusion 576R is separated rearward from the release shaft 456B when the slide member 571L is at the rear position P6*b*.

As shown in FIG. 7B, the tip of the protrusion 576R is located forward of the release shaft 456B when the slide member 571R is at the front position P7*b*. At this time, the upper surface of the protrusion 576R contacts the release shaft 456B from below to apply an upward force to the release shaft 456B and cause the release shaft 456B to be located at the separation position P5*b* above the nip position P4*b*.

As shown in FIGS. 7A and 7B, the protruding portion 577R protrudes rightward from a part near a front end and a lower end on the right side surface of the main body 574R.

The protrusion 578R protrudes downward from a position rearward of the protruding portion 577R on the lower end surface of the main body 574R. The protrusion 578R has a plate-like shape which is long in the vertical direction 7 and thin in the front-rear direction 8 and extends to a position below the upper end of the protrusion 4210R at the mount position P2*b*. The protrusion 578R has a front surface 579R.

As shown in FIG. 7A, the front surface 579R is substantially at the same position as the rear surface 4211R of the protrusion 4210R of the discharge tray 420B in the front-rear direction 8 when the slide member 571R is at the rear position P6*b* and the discharge tray 420B is at the mount position P2*b*.

As shown in FIG. 7B, when the discharge tray 420B is pulled out from the housing 200, the front surface 579R moves forward in conjunction with the movement of the slide member 571R to the front position P7*b*.

In the process in which the discharge tray 420B moves to the mount position P2*b* in the housing 200, the protrusion 4210R contacts the protrusion 578R to apply a rearward force. In this way, the slide member 571R moves from the front position P7*b* to the rear position P6*b*.

Since the slide member 571L may have a symmetrical shape with the slide member 571R with respect to the paper passage center plane C, the slide member 571L is not described in detail.

[Levers 572R and 572L, Coil Springs 573R and 573L]

Figure 8A:
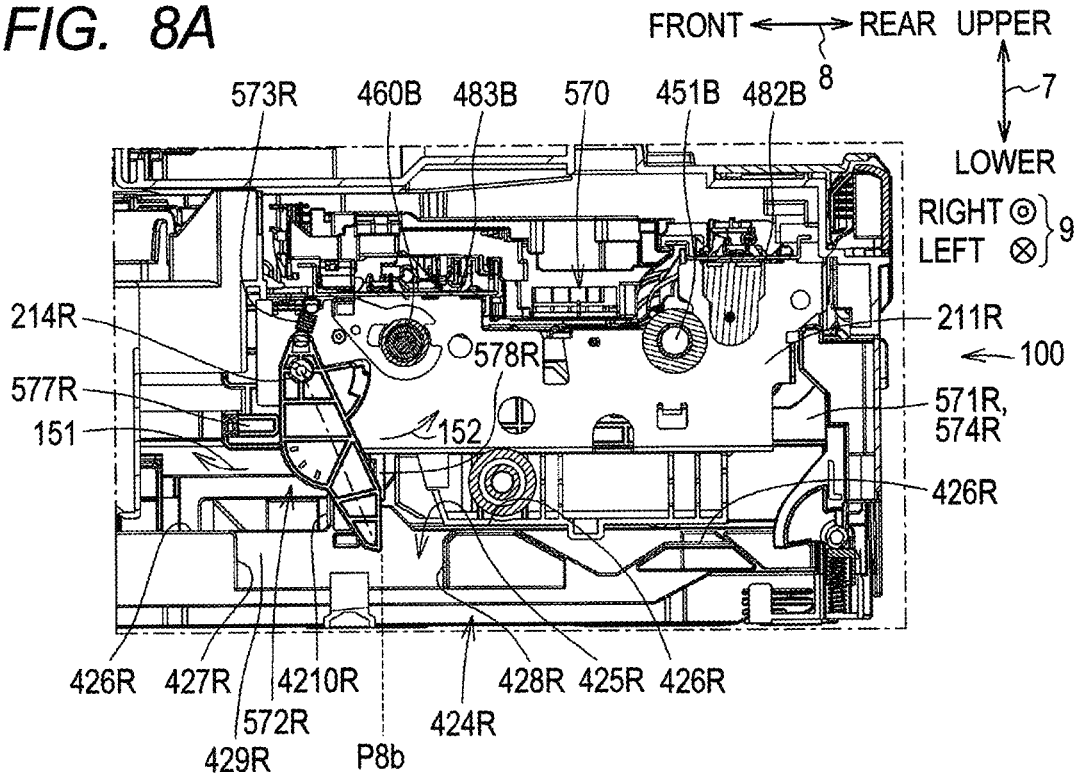
FIGS. 8A and 8B are vertical cross-sectional views showing a lever 572R of the nip release mechanism 570, where
Figure 8B:
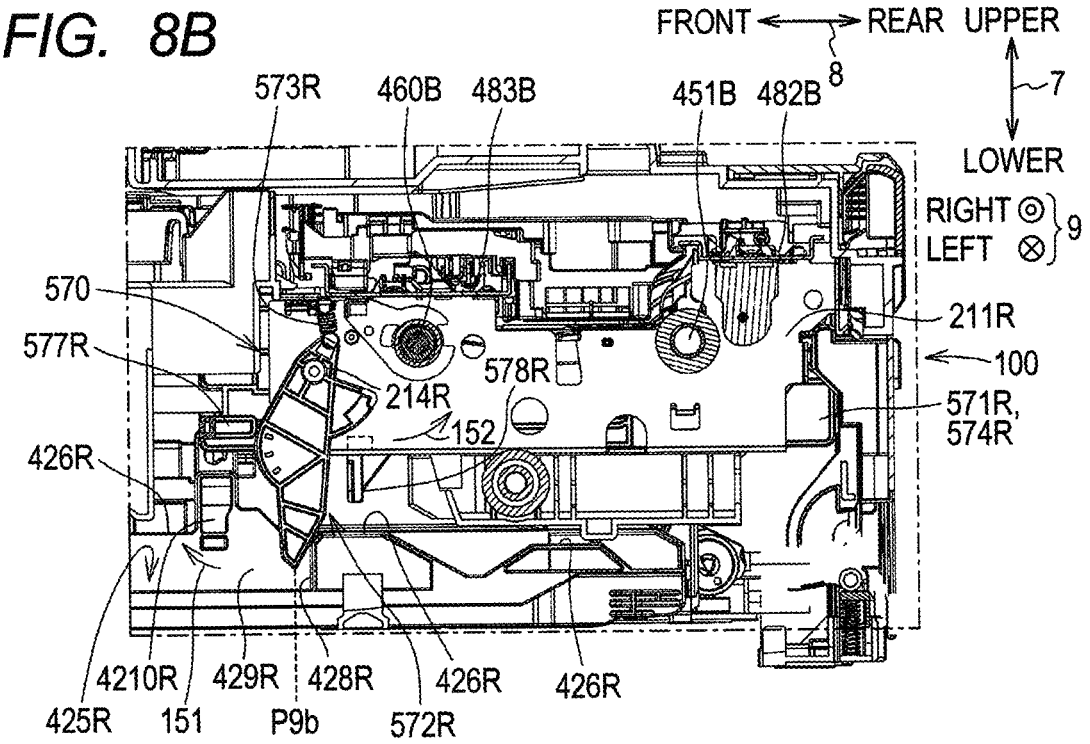

As shown in FIG. 6, the lever 572R has a plate-like shape which is thin in the left-right direction 9. As shown in FIGS. 8A and 8B, the lever 572R is supported rotatably about a shaft 214R provided on the right side surface of the side frame 211R. The lever 572R extends downward from the shaft 214R. The lever 572R is provided substantially at the same position as the concave portion 425R of the joint 424R of the discharge tray 420B in the left-right direction 9. The shaft 214R is located above the joint 424R at the mount position P2*b*. The lower end in the length direction of the coil spring 573R is connected to an upper end of the lever 572R. The upper end of the coil spring 573R is engaged near the upper end of the side frame 211R.

When the coil spring 573R has a natural length, the lower end (that is, the tip) of the lever 572R is located at a reference position P8*b* (see FIG. 8A) in a circumferential direction about a shaft center of the shaft 214R. When the lever 572R is located at the reference position P8*b* and the discharge tray 420B is located at the mount position P2*b*, the tip of the lever 572R is located at a farther rearward and lower position than the shaft 214R and between the front surface 427R and the rear surface 428B of the concave portion 425R.

The lever 572R is rotatable from the reference position P8*b* (see FIG. 8A) to a front rotation position P9*b* (see FIG. 8B) in the circumferential direction about the shaft center of the shaft 214R. The front rotation position P9*b* is a position reached by rotation in a direction of an arrow 151 along the circumferential direction from the reference position P8*b*. The arrow 151 indicates a clockwise direction in the drawing surface of FIGS. 8A and 8B. When the lever 572R rotates in the circumferential direction from the reference position P8*b*, the coil spring 573 expands or contracts. Thus, the lever 572R is urged toward the reference position P8*b* by the urging force of the coil spring 573R.

In the process in which the discharge tray 420B is pulled out forward from the mount position P2*b*, a forward force is applied to the tip of the lever 572R by the rear surface 428R of the concave portion 425R. During this time, the lever 572R rotates from the reference position P8*b* toward the front rotation position P9*b* in the circumferential direction. In the process in which the lever 572R moves to the front rotation position P9*b*, the lever 572R contacts the protruding portion 577R, whereby the forward force is applied to the protruding portion 577R. As a result, the slide member 571R moves from the rear position P6*b* to the front position P7*b*. When the slide member 571R moves to the front position P7*b* and the discharge tray 420B is further pulled out forward, the lever 572R does not receive any force from the discharge tray 420B. Thus, the lever 572R is returned to the reference position P8*b* by the urging force of the coil spring 573R.

In the process in which the discharge tray 420B is mounted to the mount position P2*b*, the tip of the lever 572R first contacts an upper surface 426R of the joint 424R. As a result, the lever 572R enters the concave portion 425R after rotating from the reference position P8*b* in a direction indicated by an arrow 152 (the direction opposite the direction toward the front rotation position P9*b*) and moving on the upper surface 426R relative to the upper surface 426R. In the relative moving process, the lever 572R does not substantially act on the slide member 571R, and the protrusion 4210R of the joint 424R contacts the protrusion 578R of the slide member 571R. As a result, the slide member 571R moves from the front position P7*b* to the rear position P6*b*.

Since the lever 572L and the coil spring 573L may have symmetrical shapes with the lever 577R and the coil spring 573R with respect to the paper passage center plane C, the lever 572L and the coil spring 573L are not described in detail.

[Sheet Sensors 520A and 520B]

In FIG. 9, the sheet sensor 520A is provided at a particular position P10*a* (see FIG. 3) near the discharge port 444A in the conveyance path 440A. The sheet sensor 520A outputs a sheet signal S2*a* to the controller 560. The sheet signal S2*a* has a level equal to or higher than a sheet threshold value described later when the sheet 1A is not at the particular position P10*a*, and has a level lower than the sheet threshold value when the sheet 1A is at the particular position P10*a*.

The sheet sensor 520B is provided at a particular position P10*b* near the discharge port 444B in the conveyance path 440B. The sheet sensor 520B outputs a sheet signal S2*b* to the controller 560. The sheet signal S2*b* has a level equal to or higher than a sheet threshold value described later when the sheet 1B is not at the particular position P10*b*, and has a level lower than the sheet threshold value when the sheet 1B is at the particular position P10*b*.

The sheet sensor 520A is an example of a lower sheet sensor (sheet sensor). The sheet sensor 520B is an example of an upper sheet sensor.

[Discharge Tray Sensor 540B]

The discharge tray sensor MOB (an example of an upper tray sensor (tray sensor)) is an active optical sensor, for example. The discharge tray sensor MOB is provided near the rear end of the joint 424R at the mount position P2*b*. The discharge tray sensor MOB periodically outputs tray signals S4*b* to the controller 560. The tray signal S4*b* has a level lower than a tray threshold value when the discharge tray 420B is at the mount position P2*b*, and has a level equal to or higher than the tray threshold value when the discharge tray 420B is not at the mount position P2*b*.

[Controller 560]

In FIG. 9, the controller 560 has a CPU, a ROM, a RAM, an EEPROM, an ASIC, and so on mounted on a control circuit board provided in the housing 200. The CPU, the ROM, the RAM, the EEPROM, and the ASIC are connected to each other by an internal bus so as to communicate with each other. The ROM stores a program and so on for controlling the operation of the printer 100. The CPU executes the program while using the RAM and the EEPROM.

In response to receiving a job transmitted by an information processing device configured to communicate with the printer 100, the controller 560 controls each component of the printer 100 in order to record an image based on image data according to condition information.

Specifically, the controller 560 controls each component of the printer 100 so as to record an image based on the image data included in one of two jobs by using the recording head 480A and to record an image based on the image data contained in the other of the two jobs by using the recording head 480B.

In addition, in a case where one job includes image data indicating a plurality of images, the controller 560 may control each component of the printer 100 so as to record a part of the images by using the recording head 480A and to record the remaining images by using the recording head 480B.

[Operation of Printer 100]

Hereinafter, the operation of the printer 100 will be described with reference to FIG. 10. Note that FIG. 10 shows the operation of the printer 100 in image recording for one sheet 1A, 1B.

In a state where the printer 100 is ready to record an image, the supply trays 410A, 410B are located in the housing 200. The discharge tray 420B is located at the mount position P2*b*, and the lower end surface 422B of the discharge tray 420B is located at the closed position P3*b*. The cover 218 is located at the closed position P12. In this way, the user is not able to access the conveyance paths 440A, 440B. The release shaft 456B is located at the nip position P4*b*, the slide member 571L is located at the rear position P6*b*, and the lever 572R is located at the reference position P8*b*.

Figure 10:
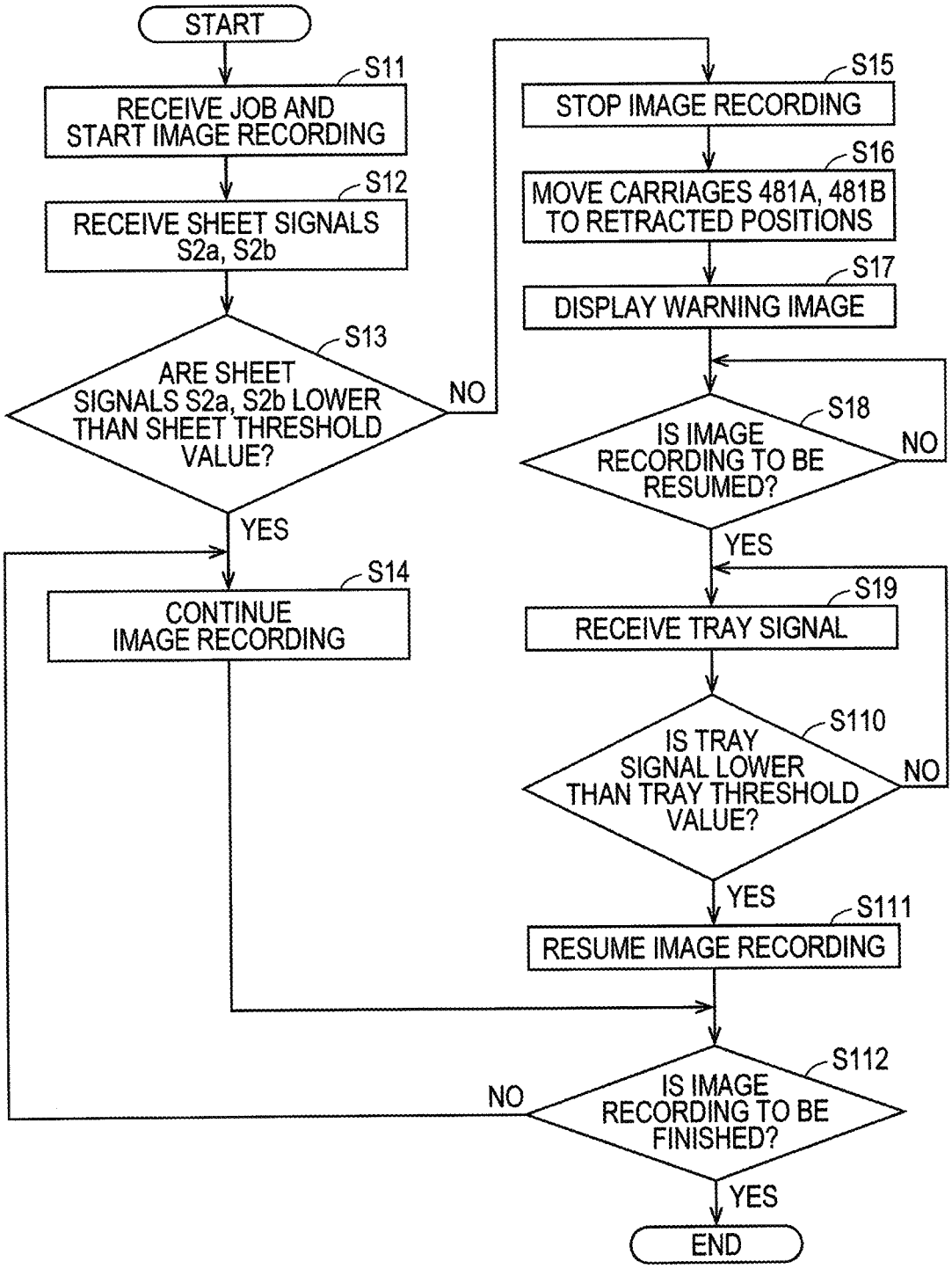
FIG. 10 is a flowchart showing the operation of the printer 100.

In FIG. 10, in response to receiving a job transmitted from an information processing device in S11, the controller 560 starts to record an image by using the recording heads 480A, 480B. At this time, the controller 560 outputs drive signals to the conveyance motors 551A, 551B to cause the feed mechanisms 430A, 430B to start feeding the sheets 1A, 1B and rotate the conveyance roller pairs 450A, 450B and the discharge roller pairs 460A, 460B.

In S12, the controller 560 receives sheet signals S2*a*, S2*b* from the sheet sensors 520A, 520B.

In S13, the controller 560 determines whether the received sheet signals S2*a*, S2*b* have fallen below the sheet threshold value by the time when a particular time elapses from the feeding start of the feed mechanisms 430A, 430B (hereinafter, also referred to as a "particular period").

If the controller 560 determines that both of the sheet signals S2*a*, S2*b* have fallen below the sheet threshold value (S13: YES), no jam has occurred in the conveyance paths 440A, 440B. Thus, the controller 560 continues the image recording using the recording heads 480A, 480B (S14). In response to determining that at least one of the sheet signals S2*a*, S2*b* has not fallen below the sheet threshold value (that is, at least one of the sheet signals S2*a*, S2*b* remains above the sheet threshold value) (S13: NO), the controller 560 stops the image recording using the recording heads 480A, 480B, assuming that a jam has occurred (S15). At this time, the controller 560 not only stops the operation of the recording heads 480A, 480B, but also stops output of the drive signals to the conveyance motors 551A, 551B.

After stopping the image recording, the controller 560 controls the carriages 481A, 481B to move to the retracted positions 484L, 484R (S16). In particular, the controller 560 starts outputting drive signals to the carriage motors 552A, 552B and starts moving each of the carriages 481A, 481B to one of the retracted positions 484L, 484R. At this time, the controller 560 receives pulse signals S1*a*, S1*b* from the encoder sensors 486A, 486B and determines the positions of the carriages 481A, 481B based on the received pulse signals S1*a*, S1*b*. In response to determining that each of the carriages 481A, 481B has reached one of the retracted positions 484L, 484R, the controller 560 stops the output of the drive signals to the carriage motors 552A, 552B. In this way, the carriages 481A, 481B stop at the retracted position 484L or 484R.

After stopping the image recording, the controller 560 further generates image data representing a warning image and transmits the generated image data to the display 510. When the sheet signal S2*a* is not lower than the sheet threshold value, the warning image is an image showing that a jam has occurred in the conveyance path 440A. When the sheet signal S2*b* is not lower than the sheet threshold value, the warning image is an image showing that a jam has occurred in the conveyance path 440B. If neither of the sheet signals S2*a*, S2*b* is lower than the sheet threshold value, the warning image is an image showing a jam has occurred in both of the conveyance paths 440A, 440B. The display 510 displays the warning image based on the received image data (S17). After viewing the warning image, the user pulls out the discharge tray 420B at the mount position P2*b* forward.

In the process in which the discharge tray 420B is pulled out, the lower end surface 422B of the discharge tray 420B moves forward from the closed position P3*b* to open the opening 206. The user accesses the conveyance path 440A through the opening 206 and removes the sheet 1A jammed in the conveyance path 440A if the jam has occurred in the conveyance path 440A.

In the process in which the discharge tray 420B is pulled out, the rear surface 428R of the concave portion 425R of the joint 424R contacts the tip of the lever 572R from the rear and further moves forward even thereafter. Thus, the lever 572R rotates toward the front rotation position P9*b* from the reference position P8*b*. In the process in which the lever 572R is rotated to the front rotation position P9*b*, the lever 572R contacts the protruding portion 577R of the slide member 571R from the rear and rotates in the circumferential direction indicated by the arrow 151 even thereafter. Therefore, a force including a forward component is applied to the protruding portion 577R. In this way, the slide member 571R moves from the rear position P6*b* to the front position P7*b*. As a result, a force including an upward component is applied to the release shaft 456B by the protrusion 576R of the slide member 571R. As a result, the release shaft 456B moves from the nip position P4*b* to the separation position P5*b* to form a gap between each pinch roller 452B and the drive roller 451B. If a jam has occurred in the conveyance path 440B, the user moves the cover 218 from the closed position P12 to the open position P13. Thereafter, the user removes the sheet 1B jammed in the conveyance path 440B.

After S17, the controller 560 determines whether to resume image recording (S18). In S18, the controller 560 determines whether to resume image recording, for example, based on whether the user have completed the removal of the sheet 1A, 1B and performed a particular operation on an operation panel (not shown). In response to determining that image recording is to be resumed (S18: YES), the controller 560 receives a tray signal S4*b* from the discharge tray sensor 540B (S19) and determines whether the received tray signal S4*b* has a level lower than the tray threshold value (S110).

In response to determining that the level is below the tray threshold value (S110: YES), the controller 560 resumes image recording using the recording heads 480A, 480B since the discharge tray 420B is located at the mount position P2*b* (S111).

In response to determining that the level is not lower than the tray threshold value (S110: NO), the controller 560 repeats S19 since the discharge tray 420B is not located at the mount position P2*b*. That is, the controller 560 controls the recording heads 480A, 480B not to operate.

After S14 or S111, in S112 the controller 560 determines whether to finish image recording using the recording heads 480A, 480B. In response to determining that the image recording is not to be finished (S112: NO), the controller 560 returns to S14 to continue image recording. In response to determining that the image recording is to be finished (S112: YES), the controller 560 ends the processing of FIG. 10.

[Operations and Effects of Embodiment]

According to the printer 100, the opening 206 formed above the straight portion 442B of the conveyance path 440B is opened by removing the discharge tray 420B from the housing 200. Thus, even if a jam occurs in the conveyance path 440A in the housing 200 in a configuration that the recording heads 480A, 480B are arranged in the vertical direction 7, the user can easily access the conveyance path 440A from above. In this way, the user can easily perform a jam process in the conveyance path 440A.

The discharge tray sensor 540B outputs a tray signal having a level equal to or higher than the tray threshold value when the discharge tray 420B is not at the mount position P2*b*. The controller 560 does not perform image recording using the recording heads 480A, 480B when receiving the tray signals having a level equal to or higher than the tray threshold value (S19, S110: NO in FIG. 10). This prevents image recording using the recording head 480A and so on from being performed, in a state where the user can access the conveyance path 440A.

In conjunction with the forward movement of the discharge tray 420B, the nip release mechanism 570 moves the release shaft 456B to the separation position P5*b* to form the gap between each pinch roller 452B and the drive roller 451B. The user easily removes the sheet 1B jammed in the conveyance path 440B. According to the printer 100, the jam process is easily performed in both of the conveyance paths 440A, 440B by pulling out the discharge tray 420B.

The nip release mechanism 570 operates in conjunction with the forward movement of the discharge tray 420B located closer to the conveyance roller pair 450B than to the supply trays 410A, 410B. Thus, a force for moving the slide member 571R in the front-rear direction 8 is easily transferred and the slide member 571R is reduced in size.

Since the controller 560 controls the carriage 481A to move to one of the retracted positions 484L, 484R (S16), the user easily accesses the conveyance path 440A through the opening 206.

[First Modification]

Figure 11A:
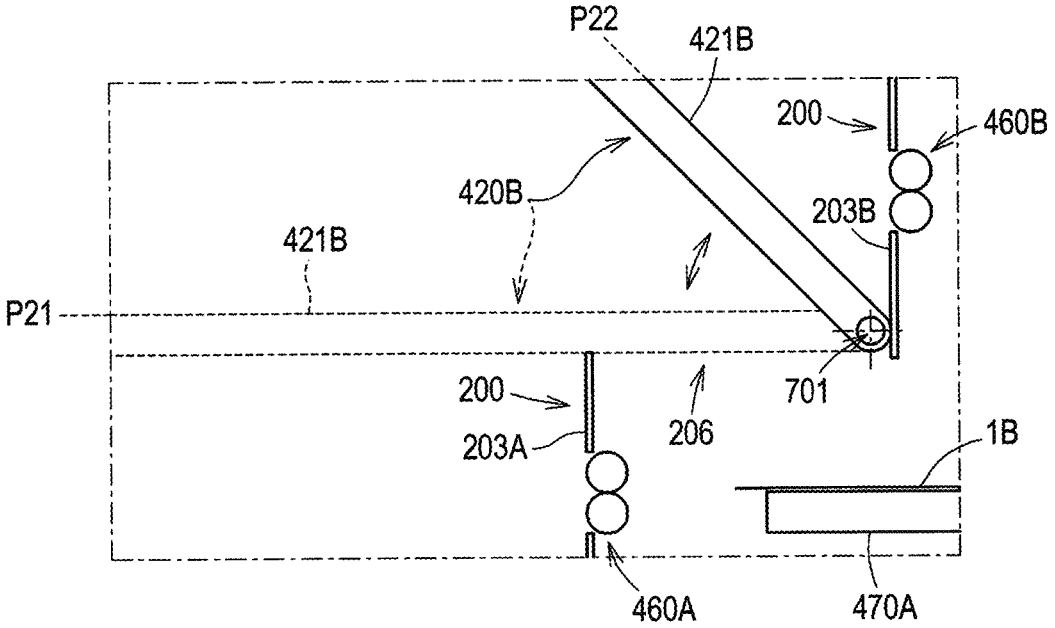
FIGS. 11A and 11B are schematic views showing a discharge tray 420B according to a first modification.

In the embodiment, the discharge tray 420B is movable in the front-rear direction 8. Alternatively, as shown in FIG. 11A, the entire discharge tray 420B may be configured to rotatably move about a shaft 701 extending in the left-right direction 9 relative to the housing 200. The shaft 701 is located at the rear end of the support surface 421B of the discharge tray 420B. In this case, the discharge tray 420B rotatably moves between a closed position P21 and an open position P22 in a circumferential direction about a shaft center of the shaft 701. The closed position P21 is a position for closing the opening 206. The open position P22 is a position separated, with respect to the closed position P21, from the opening 206 in a direction toward the upper back wall 203B in the circumferential direction about the shaft center of the shaft 701. The closed position P21 is another example of the closed position, and the circumferential direction about the shaft center of the shaft 701 is another example of the closing direction and the opening direction.

By setting an angle between the support surface 421B at the closed position P21 and the support surface 421B at the open position P22 at approximately 45 degrees, the controller 560 may perform image recording using the recording head 480B even while the user is processing a jam which has occurred in the conveyance path 440A.

Figure 11B:
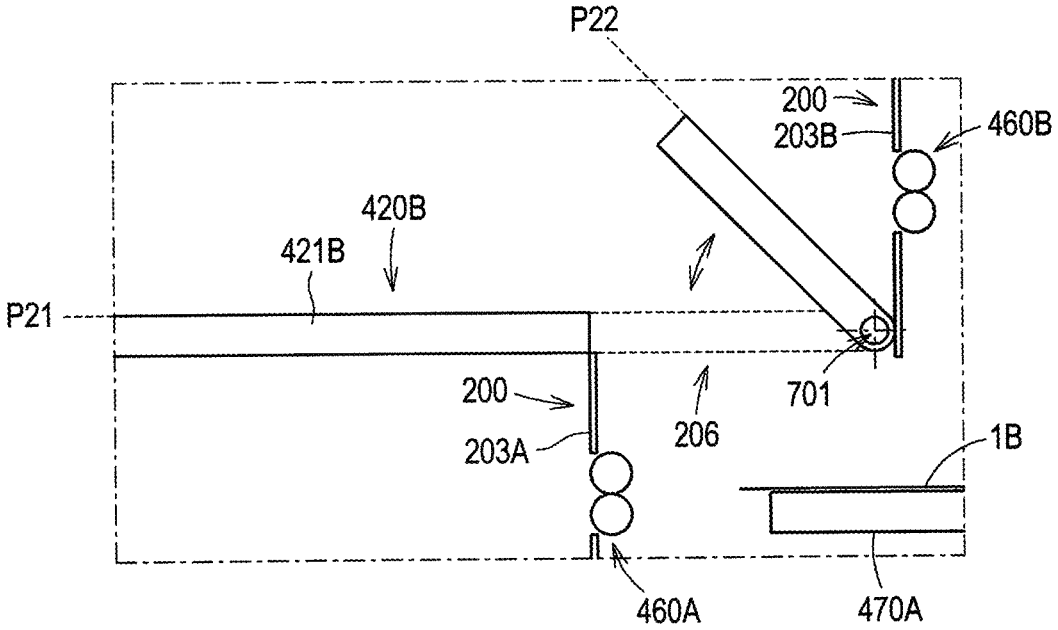

Alternatively, as shown in FIG. 11B, a part located above the opening 206 in the discharge tray 420B at the mount position P2*b* may be configured to be rotatable about the shaft 701 extending in the left-right direction 9 relative to the housing 200.

In a case where the discharge tray 420B has a configuration shown in FIGS. 11A and 11B, the printer 100 may be configured such that the release shaft 456B is moved between the nip position P4*b* (see FIG. 7A) and the separation position P5*b* (see FIG. 7B) by a known mechanism different from the nip release mechanism 570.

[Second Modification]

In the processing of FIG. 10, when a jam has occurred, the controller 560 stops both of the image recording using the recording heads 480A, 480B in S15. However, in the printer 100, the conveyance path 440A connects the supply tray 410A and the discharge tray 420A and the conveyance path 440B connects the supply tray 410B and the discharge tray 420B. Thus, the controller 560 may execute the following control.

Specifically, in response to determining that the sheet signal S2*a* is not lower than the sheet threshold value during the execution of image recording using the recording heads 480A, 480B, the controller 560 controls the display 510 to display a warning image inquiring whether to stop image recording using the recording head 480B. The warning image includes a character string such as "Do not remove discharge tray 420B when continuing image recording using recording head 480B". The user operates an input device such as an operation key or touch sensor to give the printer 100 an input as to whether to continue image recording using the recording head 480B. The controller 560 may stop image recording using the recording head 480B in response to receiving a user operation indicating that the image recording is not continued, and may continue the image recording using the recording head 480B in response to receiving a user operation indicating that the image recording is continued.

Similarly, in response to determining that the sheet signal S2*b* is not lower than the sheet threshold value, the controller 560 may stop only image recording using the recording head 480B and continue image recording using the recording head 480A.

According to the above processing, in a case where no jam has occurred in the conveyance path 440B, image recording using the recording head 480B can be continued. Further, the discharge of the sheet 1B from the discharge port 444B can be suppressed in a state where the discharge tray 420B is not at the mount position P2*b*.

[Third Modification]

Figure 12A:
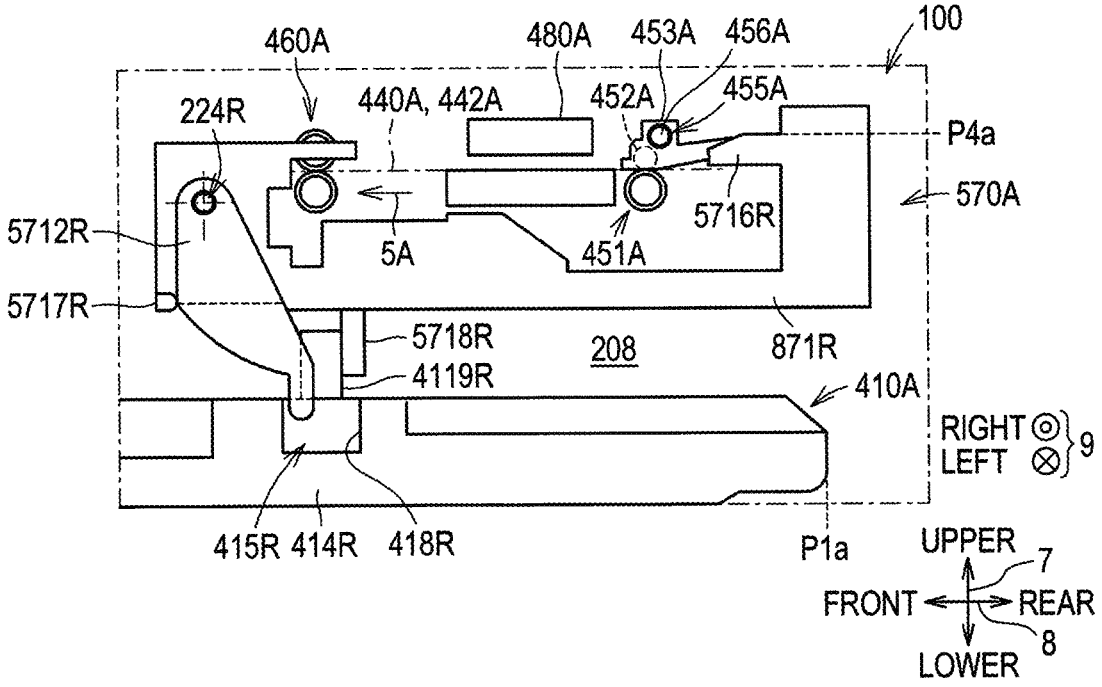
FIGS. 12A and 12B are schematic views showing the configuration of a nip release mechanism 570A according to a third modification.
Figure 12B:
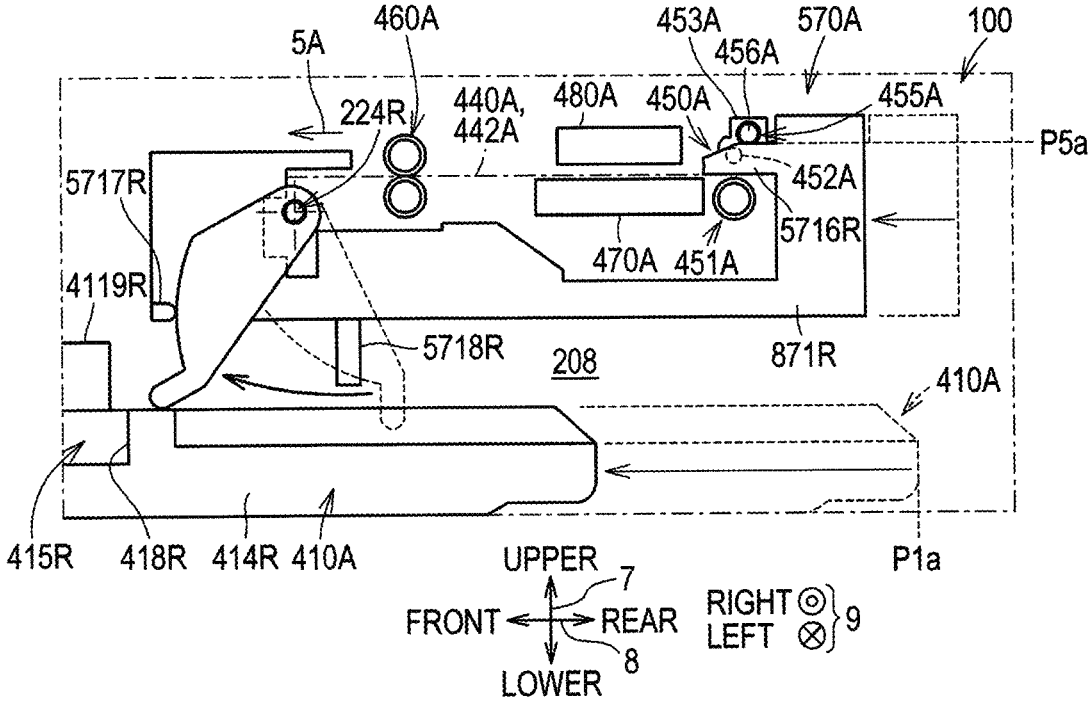

In the embodiment, the printer 100 includes the nip release mechanism 570 for moving the release shaft 456B between the nip position P4*b* (see FIG. 7A) and the separation position P5*b* (see FIG. 7B). As shown in FIGS. 12A and 12B, the printer 100 may further include a nip release mechanism 570A for the conveyance roller pair 450A. In FIGS. 12A and 12B, the nip release mechanism 570A has a configuration similar to that of the nip release mechanism 570 shown in FIGS. 6 to 8B. Thus, the description thereof is simplified. Since the nip release mechanism 570A has a symmetrical shape in the left-right direction 9 with respect to the paper passage center plane C, only the configuration of the nip release mechanism 570A on the right side is described below.

In the printer 100, the supply tray 410A is mounted at a mount position P1*a* (an example of a mount position) in the housing space 208 (see FIG. 12A) by moving rearward (an example of a mount direction) in the housing space 208 through the opening 207 (see FIG. 2). The supply tray 410A is separated from the mount position P1*a* (see FIG. 12B) by moving forward (an example of a separation direction) in the housing space 208 through the opening 207.

The conveyance roller pair 450A includes a drive roller 451A and a plurality of pinch rollers 452A as a pair of rollers. The drive roller 451A extends in the left-right direction 9 below the conveyance path 440A. Each pinch roller 452A is rotatably supported by a roller holder 453A. The roller holder 453A is urged downward by a coil spring (not shown) in contact with the upper surface of the roller holder 453A. In this way, each pinch roller 452A contacts the drive roller 451A.

A part of each roller holder 453A above the pinch roller 452A is formed with a through hole 455A penetrating through the roller holder 453A in the left-right direction 9. A release shaft 456A extending in the left-right direction 9 is inserted into each through hole 455A. Both left and right ends of the release shaft 456A are supported by the frame of the housing 200. When an upward force is applied to the release shaft 456A, the roller holder 453A is movable in the vertical direction 7 together with each pinch roller 452A against the urging force of each coil spring 454A.

The release shaft 456A is an example of a lower separation member (separation member) and is movable between a nip position P4*a* (see FIG. 12A) and a separation position P5*a* (see FIG. 12B). The nip position P4*a* is a position of the release shaft 456A where each pinch roller 452A is in contact with the drive roller 451A. The separation position P5*a* is a position above the nip position P4*a* and a position of the release shaft 456A where each pinch roller 452A is separated from the drive roller 451A.

The roller holder 453A and the release shaft 456A constitute a part of the configuration of the nip release mechanism 570A.

The nip release mechanism 570A includes a slide member 871R. In the process in which the supply tray 410A moves to the mount position P1*a*, the tip of a lever 5712R enters a concave portion 415R located in a right side wall 414R of the supply tray 410A. A protrusion 5718R protruding downward from the lower end of the slide member 871R contacts a protrusion 4119R located to the left of the concave portion 415R on the right side wall 414R. A protrusion 5716R is located near the rear end and upper end of the slide member 871R. When the supply tray 410A is at the mount position P1*a* (see FIG. 12A), the protrusion 5716R is separated rearward from the release shaft 456A. Thus, the release shaft 456A is located at the nip position P4*a*.

In the process in which the supply tray 410A moves forward from the mount position P1*a* (see FIG. 12B), the tip of the lever 5712R contacts a rear surface 418R defining the concave portion 415R of the supply tray 410A. As a result, the lever 5712R rotates forward and upward about a shaft center 224R extending along the left-right direction 9 and contacts a protrusion 5717R of the slide member 871R, and the slide member 871R moves forward. In conjunction with the forward movement of the slide member 871R, the protrusion 5716R contacts the release shaft 456A from below to apply a force including an upward component to the release shaft 456A. As a result, the release shaft 456A moves from the nip position P4*a* to the separation position P5*a*.

According to the nip release mechanism 570A, by moving the supply tray 410A forward, the rollers of the conveyance roller pair 450A are separated from each other. Thus, the user can easily process a jam which has occurred in the conveyance path 440A. Since the supply tray 410A is located near the conveyance roller pair 450A, a force generated by a movement of the supply tray 410A can be transferred to the release shaft 456A in a short path. Further, the nip release mechanism 570A can be reduced in size.

[Other Modifications]

While the disclosure has been described in detail with reference to the above aspects thereof, it would be apparent to those skilled in the art that various changes and modifications may be made therein without departing from the scope of the claims.

Figure 13:
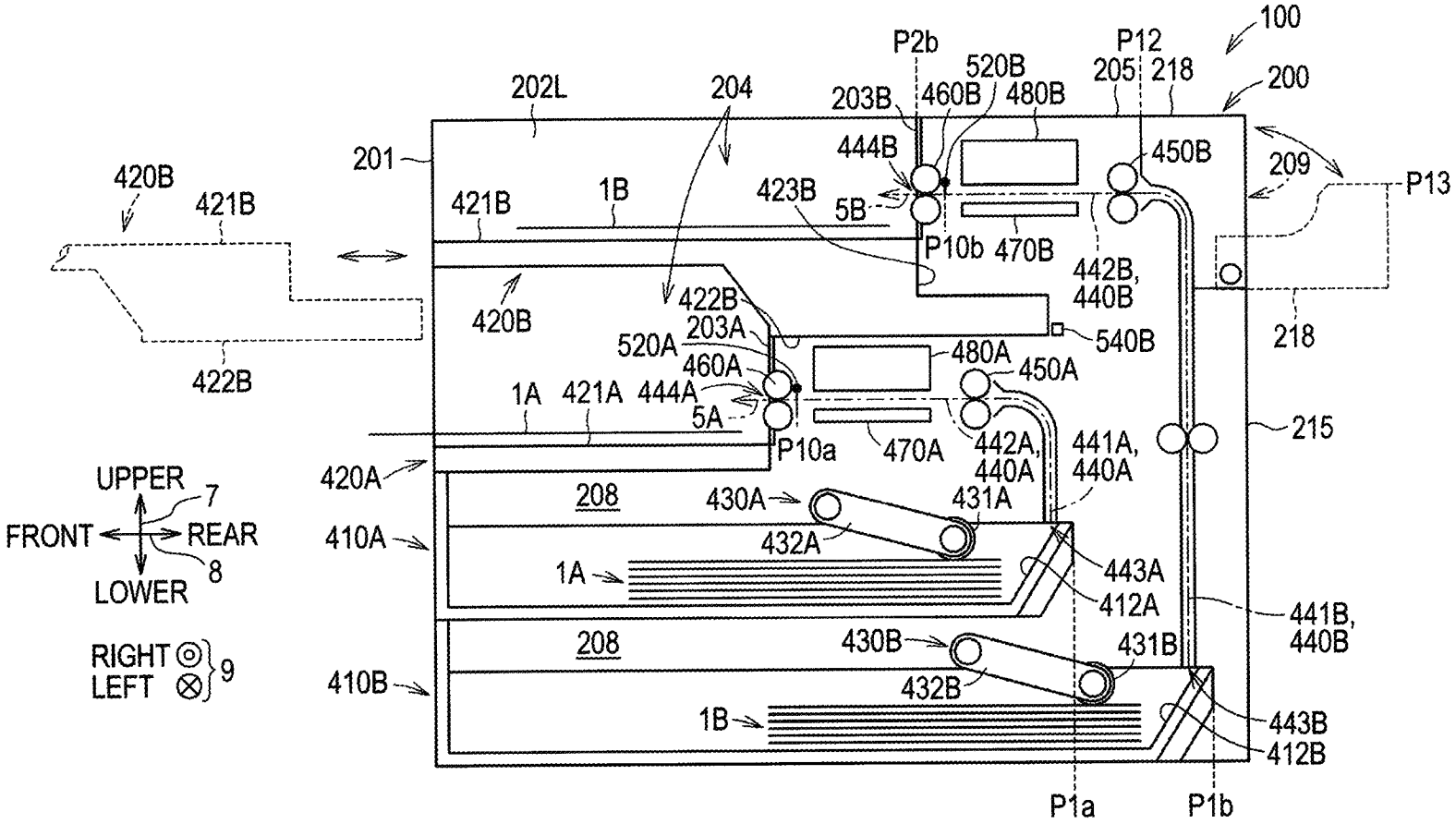
FIG. 13 is a schematic view of a vertical cross section of a printer 100 according to another modification.

According to another modification shown in FIG. 13, the feed mechanism 430B is shifted rearward from the position of FIG. 3. In this configuration, the mount position P1*b* (rear end position) of the supply tray 410B is located farther rearward than the mount position P1*a* (rear end position) of the supply tray 410A. The sheet feed position of the feed tray 410B (the sheet discharge position from the feed tray 410B) is located farther rearward than the sheet feed position of the feed tray 410A (the sheet discharge position from the feed tray 410A). More specifically, the guide surface 412B is located farther rearward than the guide surface 412A. That is, the guide surface 412B is located downstream of the guide surface 412A in the mount direction of the supply tray 410A, 410B. The supply port 443B (the sheet feed position of the feed tray 410B) is located farther rearward than the supply port 443A (the sheet feed position of the feed tray 410A). As a result, the curved portion 441B extends vertically. Further, the feed roller 431B is located farther rearward than the feed roller 431A. Thus, the feed roller 431B is closer to the rear end of the housing 200 than the feed roller 431A is.

In the embodiment, the lower end surface 422B of the discharge tray 420B serves as the cover for the opening 206. Alternatively, a cover member structurally or mechanically connected to the discharge tray 420B below the discharge tray 420B may close the opening 206.

The conveyance paths 440A, 440B may be so-called S-shaped paths or straight paths. In a case where the conveyance paths 440A, 440B are straight paths, the supply trays 410A, 410B and the discharge trays 420A, 420B are separated in the front-rear direction 8 or in the left-right direction 9.

The printer 100 may be configured such that the release shaft 456B is moved between the nip position P4*b* (see FIG. 7A) and the separation position P5*b* (see FIG. 7B) by a known mechanism other than the nip release mechanism 570.

The controller 560 determines whether a jam has occurred in the conveyance paths 440A, 440B based on the sheet signals S2*a*, S2*b* transmitted from the sheet sensors 520A, 520B in S13 of FIG. 10. The sheet sensors 520A, 520B are located near the discharge ports 444A, 444B. Alternatively, the sheet sensors 520A, 520B may be located immediately upstream of the conveyance roller pairs 450A, 450B or near the supply ports 443A, 443B in the conveyance paths 440A, 440B.

The controller 560 may determine whether a jam has occurred in the conveyance paths 440A, 440B based on the rotation speeds of the conveyance roller pairs 450A, 450B.

What is claimed is:

1. An image recording apparatus comprising:

a housing in which a first conveyance path and a second conveyance path are formed, the first conveyance path extending in a conveyance direction to reach a first discharge port for discharging a sheet, the second conveyance path extending in the conveyance direction at a position higher than the first conveyance path to reach a second discharge port for discharging a sheet, the second discharge port being located at a position upstream of the first discharge port in the conveyance direction;

a first print engine provided at the first conveyance path, the first print engine being configured to print an image by using a recording agent on a sheet conveyed along the first conveyance path; and a second print engine provided at the second conveyance path, the second print engine being configured to print an image by using a recording agent on a sheet conveyed along the second conveyance path, wherein the second print engine is located at a position upstream of the first print engine in the conveyance direction.

2. The image recording apparatus according to claim 1, further comprising:

a sheet sensor configured to output a sheet signal having a different level depending on whether a sheet exists at a particular position in the first conveyance path;

a display; and a controller configured to:

determine, based on the sheet signal, whether a sheet is jammed in the first conveyance path;

in response to determining that a sheet is jammed in the first conveyance path, output, to the display, image data indicating a warning of whether to stop an operation of the second print engine; and control the display to display an image indicating the warning based on the image data.

3. The image recording apparatus according to claim 1, further comprising:

a sheet sensor configured to output a sheet signal having a different level depending on whether a sheet exists at a particular position in the first conveyance path;

a drive mechanism configured to convey the first print engine between a print position on the first conveyance path and a retracted position separated from the print position in an intersecting direction intersecting the conveyance direction; and a controller configured to:

determine, based on the sheet signal, whether a sheet is jammed in the first conveyance path;

in response to determining that a sheet is jammed in the first conveyance path, output, to the drive mechanism, a drive signal for conveying the first print engine to the retracted position.

4. The image recording apparatus according to claim 1, further comprising:

a first supply tray configured to support a sheet to be conveyed along the first conveyance path; and a second supply tray configured to support a sheet to be conveyed along the second conveyance path.

5. The image recording apparatus according to claim 1, further comprising a cover movable between an open position at which the cover opens an opening above the first print engine and a closed position at which the cover closes the opening above the first print engine.

6. An image recording apparatus comprising:

a housing in which a first conveyance path and a second conveyance path are formed, the first conveyance path extending in a conveyance direction to reach a first discharge port for discharging a sheet, the second conveyance path extending in the conveyance direction at a position higher than the first conveyance path to reach a second discharge port for discharging a sheet, the second discharge port being located at a position upstream of the first discharge port in the conveyance direction;

a first print engine provided at the first conveyance path, the first print engine being configured to print an image by using a recording agent on a sheet conveyed along the first conveyance path;

a second print engine provided at the second conveyance path, the second print engine being configured to print an image by using a recording agent on a sheet conveyed along the second conveyance path;

a first discharge tray extending from the first discharge port in the conveyance direction;

a second discharge tray extending from the second discharge port in the conveyance direction when the second discharge tray is located at a mount position, the second discharge tray being located at a higher position than the first discharge tray when the second discharge tray is located at the mount position, the second discharge tray being configured to move in a mount direction toward the mount position and in a separation direction away from the mount position; and a cover connected to the second discharge tray, the cover being configured to move in a closing direction toward a closed position where the cover closes the first conveyance path from above and in an opening direction in which the cover separates from the closed position to open the first conveyance path, the cover being configured to:

when the second discharge tray is located at the mount position, be located at the closed position; and when the second discharge tray moves in the separation direction from the mount position, move in the opening direction from the closed position.

7. The image recording apparatus according to claim 6, further comprising:

a tray sensor configured to output a tray signal having a particular level when the second discharge tray is not at the mount position; and a controller configured to, in response to acquiring the tray signal of the particular level, control the first print engine not to operate.

8. The image recording apparatus according to claim 6, further comprising:

a conveyance roller pair including two rollers configured to contact each other upstream of the second print engine in the second conveyance path; and a separation member configured to move between:

a contact position where the two rollers contact each other; and a separation position where the two rollers are separated from each other, the separation member being configured to:

be located at the contact position when the second discharge tray is located at the mount position; and move from the contact position to the separation position when the second discharge tray moves in the separation direction from the mount position.

9. The image recording apparatus according to claim 8, further comprising a slide member configured to move in the separation direction when the second discharge tray moves in the separation direction, the slide member having a protrusion protruding in the separation direction, wherein, when the slide member moves in the separation direction, the protrusion contacts the separation member to cause the two rollers to separate from each other.

10. The image recording apparatus according to claim 6, wherein a lower surface of the second discharge tray serves as the cover.

11. The image recording apparatus according to claim 6, wherein, when the second discharge tray moves in the separation direction, at least part of the second discharge tray rotatably moves upward about a shaft provided below the second discharge port.

12. An image recording apparatus comprising:

a housing in which a first conveyance path and a second conveyance path are formed, the first conveyance path extending in a conveyance direction to reach a first discharge port for discharging a sheet, the second conveyance path extending in the conveyance direction at a position higher than the first conveyance path to reach a second discharge port for discharging a sheet, the second discharge port being located at a position upstream of the first discharge port in the conveyance direction;

a first print engine provided at the first conveyance path, the first print engine being configured to print an image by using a recording agent on a sheet conveyed along the first conveyance path;

a second print engine provided at the second conveyance path, the second print engine being configured to print an image by using a recording agent on a sheet conveyed along the second conveyance path;

a first supply tray configured to support a sheet to be conveyed along the first conveyance path; and a second supply tray configured to support a sheet to be conveyed along the second conveyance path, wherein the first supply tray is configured to move in a mount direction to a mount position in the housing and in a separation direction away from the mount position;

wherein the image recording apparatus further comprises:

a conveyance roller pair including two rollers configured to contact each other upstream of the first print engine in the first conveyance path; and a separation member configured to move between:

a contact position where the two rollers contact each other; and a separation position where the two rollers are separated from each other; and wherein the separation member is configured to:

be located at the contact position when the first supply tray is located at the mount position; and move from the contact position to the separation position when the first supply tray moves in the separation direction.

13. An image recording apparatus comprising:

a housing in which a first conveyance path and a second conveyance path are formed, the first conveyance path extending in a conveyance direction to reach a first discharge port for discharging a sheet, the second conveyance path extending in the conveyance direction at a position higher than the first conveyance path to reach a second discharge port for discharging a sheet, the second discharge port being located at a position upstream of the first discharge port in the conveyance direction;

a first print engine provided at the first conveyance path, the first print engine being configured to print an image by using a recording agent on a sheet conveyed along the first conveyance path;

a second print engine provided at the second conveyance path, the second print engine being configured to print an image by using a recording agent on a sheet conveyed along the second conveyance path;

a first supply tray configured to support a sheet to be conveyed along the first conveyance path;

a second supply tray configured to support a sheet to be conveyed along the second conveyance path;

a first feed roller configured to feed the sheet in the first supply tray toward the first conveyance path; and a second feed roller configured to feed the sheet in the second supply tray toward the second conveyance path, wherein the second supply tray is located below the first supply tray;

wherein each of the first supply tray and the second supply tray is configured to be mounted into the housing in a mount direction;

wherein the first supply tray has a first guide surface configured to guide the sheet fed by the first feed roller toward the first conveyance path;

wherein the second supply tray has a second guide surface configured to guide the sheet fed by the second feed roller toward the second conveyance path; and wherein the second guide surface is located downstream of the first guide surface is in the mount direction.

14. An image recording apparatus comprising:

a housing in which a first conveyance path and a second conveyance path are formed, the first conveyance path extending in a conveyance direction to reach a first discharge port for discharging a sheet, the second conveyance path extending in the conveyance direction at a position higher than the first conveyance path to reach a second discharge port for discharging a sheet, the second discharge port being located at a position upstream of the first discharge port in the conveyance direction;

a first print engine provided at the first conveyance path, the first print engine being configured to print an image by using a recording agent on a sheet conveyed along the first conveyance path;

a second print engine provided at the second conveyance path, the second print engine being configured to print an image by using a recording agent on a sheet conveyed along the second conveyance path;

a first conveyance roller located upstream of the first print engine in the first conveyance path;

a first discharge roller located downstream of the first print engine in the first conveyance path;

a second conveyance roller located upstream of the second print engine in the second conveyance path; and a second discharge roller located downstream of the second print engine in the second conveyance path, wherein the first conveyance roller is located between the second discharge roller and the second conveyance roller in the conveyance direction.

15. An image recording apparatus comprising:

a housing in which a first conveyance path and a second conveyance path are formed;

a first supply tray configured to support a sheet to be conveyed along the first conveyance path;

a second supply tray configured to support a sheet to be conveyed along the second conveyance path, the second supply tray being located at a lower position than the first supply tray;

a first feed roller configured to feed the sheet supported by the first supply tray in a feed direction, the first conveyance path extending to guide the sheet fed by the first feed roller in an upward direction and then guide the sheet to be conveyed in a conveyance direction, the conveyance direction being opposite to the feed direction;

a second feed roller configured to feed the sheet supported by the second supply tray in the feed direction, the second conveyance path extending to guide the sheet fed by the second feed roller in the upward direction and then guide the sheet to be conveyed in the conveyance direction, a part of the second conveyance path extending in the upward direction being located downstream, in the feed direction, of a part of the first conveyance path extending in the upward direction;

a first print engine provided at the first conveyance path, the first print engine being configured to print an image by using a recording agent on the sheet conveyed along the first conveyance path in the conveyance direction;

a second print engine provided at the second conveyance path, the second print engine being configured to print an image by using a recording agent on the sheet conveyed along the second conveyance path in the conveyance direction, the second print engine being located at a higher position than the first print engine;

a first discharge tray located downstream of the first print engine in the conveyance direction, the first discharge tray being configured to support the sheet discharged through a first discharge port, the first discharge port being located between the first print engine and the first discharge tray; and a second discharge tray located downstream of the second print engine in the conveyance direction, the second discharge tray being located at a higher position than the first discharge tray, the second discharge tray being configured to support the sheet discharged through a second discharge port, the second discharge port being located between the second print engine and the second discharge tray, the second discharge port being located at a position upstream of the first discharge port in the conveyance direction.

* * * * *